US010272309B2

(12) United States Patent
Moody

(10) Patent No.: US 10,272,309 B2
(45) Date of Patent: Apr. 30, 2019

(54) OBSTACLE COURSE GAME

(71) Applicant: Ryan K. Moody, Denver, CO (US)

(72) Inventor: Ryan K. Moody, Denver, CO (US)

( * ) Notice: Subject to any disclaimer, the term of this patent is extended or adjusted under 35 U.S.C. 154(b) by 0 days.

(21) Appl. No.: 15/348,023

(22) Filed: Nov. 10, 2016

(65) Prior Publication Data

US 2018/0126240 A1 May 10, 2018

(51) Int. Cl.

| | |
|---|---|
| ***A63F 7/00*** | (2006.01) |
| ***A63B 67/00*** | (2006.01) |
| ***A63F 9/24*** | (2006.01) |
| ***A63B 67/02*** | (2006.01) |
| *A63F 7/30* | (2006.01) |

(52) U.S. Cl.

CPC ..... *A63B 67/002* (2013.01); *A63B 67/02* (2013.01); *A63F 7/0058* (2013.01); *A63F 9/24* (2013.01); *A63F 2007/301* (2013.01); *A63F 2007/3005* (2013.01); *A63F 2009/2401* (2013.01)

(58) Field of Classification Search

CPC ..... A63F 7/027; A63F 7/0058; A63F 2007/3005–2007/3015; A63B 67/02; A63B 67/002

USPC ..... 273/127 R, 441; 473/158, 173

See application file for complete search history.

(56) References Cited

U.S. PATENT DOCUMENTS 3,231,278 A 1/1966 Bonlanger
3,582,074 A * 6/1971 Menotti ..... A63F 7/0058 273/121 A
3,584,877 A 6/1971 Florian
4,239,219 A * 12/1980 Haefliger ..... A63F 7/3065 200/61.11
4,389,048 A * 6/1983 Burgess ..... A63F 7/0058 273/108.1
5,255,916 A * 10/1993 Bleich ..... A63F 7/3065 273/118 A
5,465,962 A 11/1995 Hiserman
5,863,256 A 1/1999 MacLean et al.
6,059,288 A * 5/2000 Popadiuk ..... A63F 7/027 273/118 A
6,089,570 A 7/2000 Gruber
6,371,853 B1 * 4/2002 Borta ..... A63F 7/027 273/118 A
6,419,590 B1 7/2002 Criger
6,769,993 B1 8/2004 Lasalandra
6,837,797 B2 1/2005 Hull
7,102,119 B1 9/2006 Breslow et al.
7,270,327 B1 9/2007 Hsu (Continued)

FOREIGN PATENT DOCUMENTS

EP 1405656 4/2004

*Primary Examiner* — Melba Bumgarner
*Assistant Examiner* — Laura Davison

(57) ABSTRACT

A portable, configurable obstacle course game is provided for creating an interactive, entertaining game in a small space. The game is arranged along or above a path for a rolling ball, and obstacles move into and out of the ball's path, creating challenges for the players to roll or hit the ball through the path. Players can interact with each other and set difficulty levels in various play modes. The game is portable and configurable, so that it can be arranged on different playing surfaces, with different obstacles and even environmental interactions. The game can also communicate with wireless devices such as an application on a user's mobile phone, for additional game features.

16 Claims, 18 Drawing Sheets

(56) References Cited

U.S. PATENT DOCUMENTS

| | | | | |
|---|---|---|---|---|
| 7,611,427 | B1 | 11/2009 | Cline | |
| 7,789,742 | B1 | 9/2010 | Murdock et al. | |
| 7,810,814 | B1 | 10/2010 | Chapman et al. | |
| 8,287,395 | B2 | 10/2012 | Green et al. | |
| 8,702,528 | B1 | 4/2014 | Montgomery | |
| 8,870,671 | B1 | 10/2014 | Foley | |
| 9,168,444 | B2 | 10/2015 | Overcash | |
| 9,227,122 | B2 | 1/2016 | Jakubowski | |
| 9,248,368 | B2 | 2/2016 | Stimac | |
| 9,308,429 | B1 | 4/2016 | Coffman | |
| 9,311,793 | B2 | 4/2016 | Lohbihler | |
| 9,623,319 | B2 * | 4/2017 | Miller | A63F 7/0023 |
| 2002/0039929 | A1 | 4/2002 | Morris | |
| 2002/0169027 | A1 | 11/2002 | Fowler | |
| 2005/0101417 | A1 * | 5/2005 | Hamons | A63B 63/00 473/415 |
| 2005/0275163 | A1 | 12/2005 | Turner et al. | |
| 2006/0276255 | A1 | 12/2006 | Hutchison | |
| 2007/0135224 | A1 | 6/2007 | Miller | |
| 2007/0259727 | A1 | 11/2007 | Westaway et al. | |
| 2008/0102968 | A1 | 5/2008 | Andersen | |
| 2011/0070962 | A1 | 3/2011 | Covino et al. | |
| 2016/0206954 | A1 * | 7/2016 | Miller | A63D 15/20 |
| 2016/0325163 | A1 * | 11/2016 | Tsai | A47B 25/00 |
| 2017/0001100 | A1 * | 1/2017 | Stellenberg | G07F 17/3211 |
| 2017/0197146 | A1 * | 7/2017 | Miller | A63F 13/57 |

* cited by examiner

OBSTACLE COURSE GAME

BACKGROUND

Various miniature ball game systems have been designed to mimic the interactions and activities of larger scale ball games. Examples include miniature golf sets, small indoor hoops and nets, tabletop tennis, foam darts, and other games. These games can provide entertainment in compact spaces without requiring a high level of athletic skill or preparation.

Some existing games have certain deficiencies, such as difficult assembly, reliance on specific components (for example, dedicated balls with a necessary material, weight, or sensor), or limited modes of play. As a result, the games may not be utilized very often.

The remainder of this disclosure offers solutions and improvements in this field.

DETAILED DESCRIPTION

A portable, configurable obstacle course game is provided herein for creating an interactive, entertaining game in a small space. The game is arranged along or above a path for a rolling ball, and obstacles move into and out of the ball's path, creating challenges for the players to roll or hit the ball through the path. Players can interact with each other and set difficulty levels in various play modes. The game is portable and configurable, so that it can be arranged on different playing surfaces, with different obstacles and even environmental interactions. In various embodiments, the game can also communicate with wireless devices such as an application on a user's mobile phone, for additional game features.

In an embodiment, an obstacle course game for a ball includes a portable console that is movable to position the console above or along a path for a rolling ball. First and second obstacles are supported by the console and movable into and out of the path. The first obstacle comprises a barrier, a pendulum, or a flipper. The game also includes a microcontroller, inside the console, in wired or wireless communication with the first and second obstacles. The microcontroller is programmed with instructions for operating in a first game mode comprising a single player mode, operating in a second game mode comprising a battle mode, receiving, from a user, a selection of the first or second game mode, and deploying the first and second obstacles in accordance with the selected game mode.

Figure 1A:
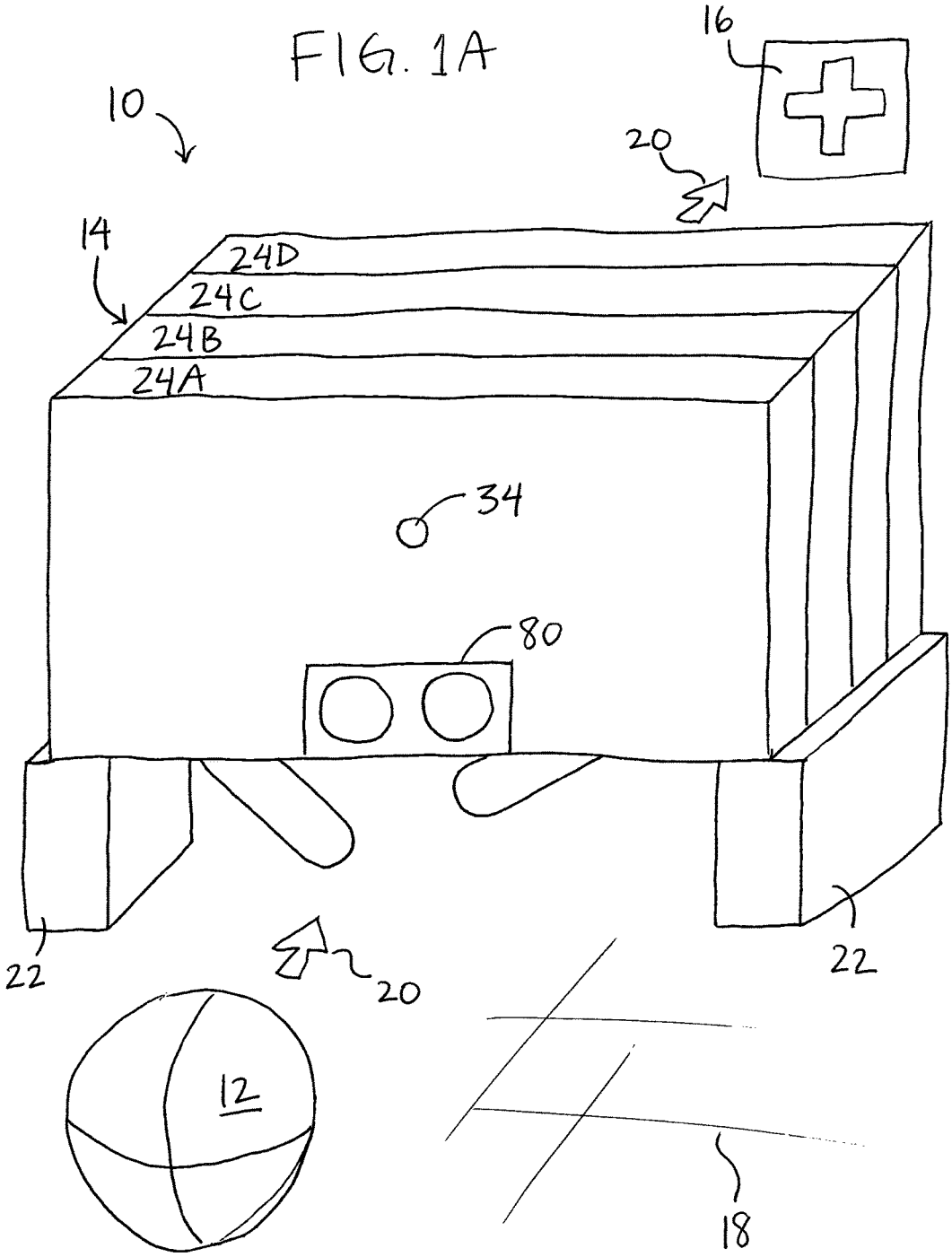
FIG. 1A is a perspective view of an obstacle course game, according to an embodiment.

An obstacle course game 10 according to an embodiment is shown in FIG. 1A. The game 10 includes a ball 12, a game console or base 14, and (optionally) a remote target 16. The console 14 is a portable unit that can be moved easily to position it on a desired playing surface 18, such as an interior surface (carpet, rug, hard floors, or others) or exterior surface (turf grass, artificial grass, concrete, or others). The console 14 is positioned above or along a path 20 for the rolling ball 12. In one embodiment, an objective of the game is to roll the ball (such as by hand or with a golf putter) along the path 20, past the console 14, to strike the target 16. The console is easily portable so that it can be positioned in various ways in different rooms or environments, utilizing different targets, so that the game can be re-configured to provide new obstacles and challenges, at various skill levels, for the players. The ball can be a small plastic or rubber ball, a golf ball, a foam ball, or other suitable ball. The properties of the ball aren't essential for the game to operate; for example, the ball can be bouncy or hard, plastic or foam, or various sizes, and the ball doesn't need to have any particular sensors or features (such as hook-and-loop fasteners, magnets, etc).

Figure 1B:
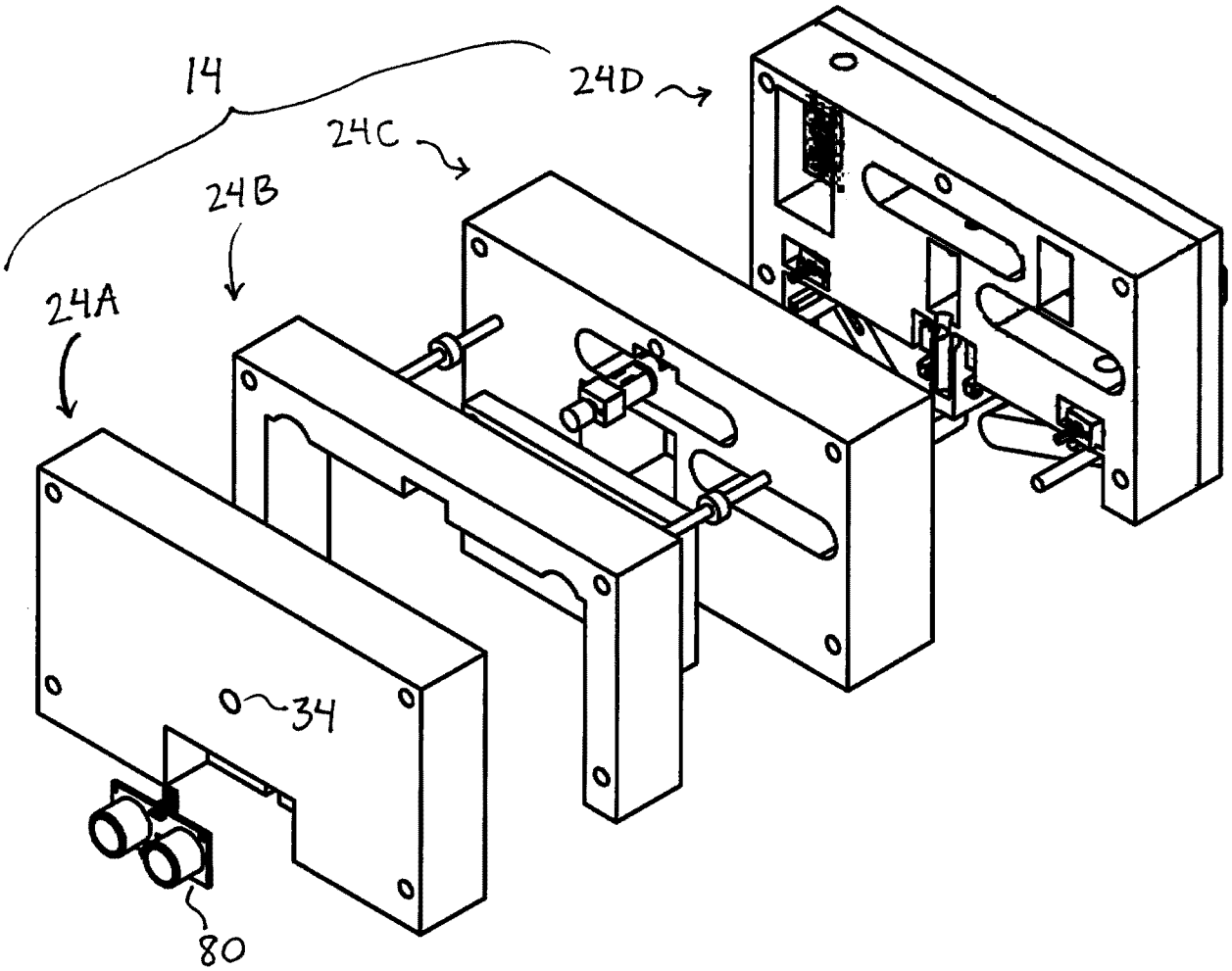
FIG. 1B is an exploded view of a console of an obstacle course game, according to an embodiment.
Figure 2:
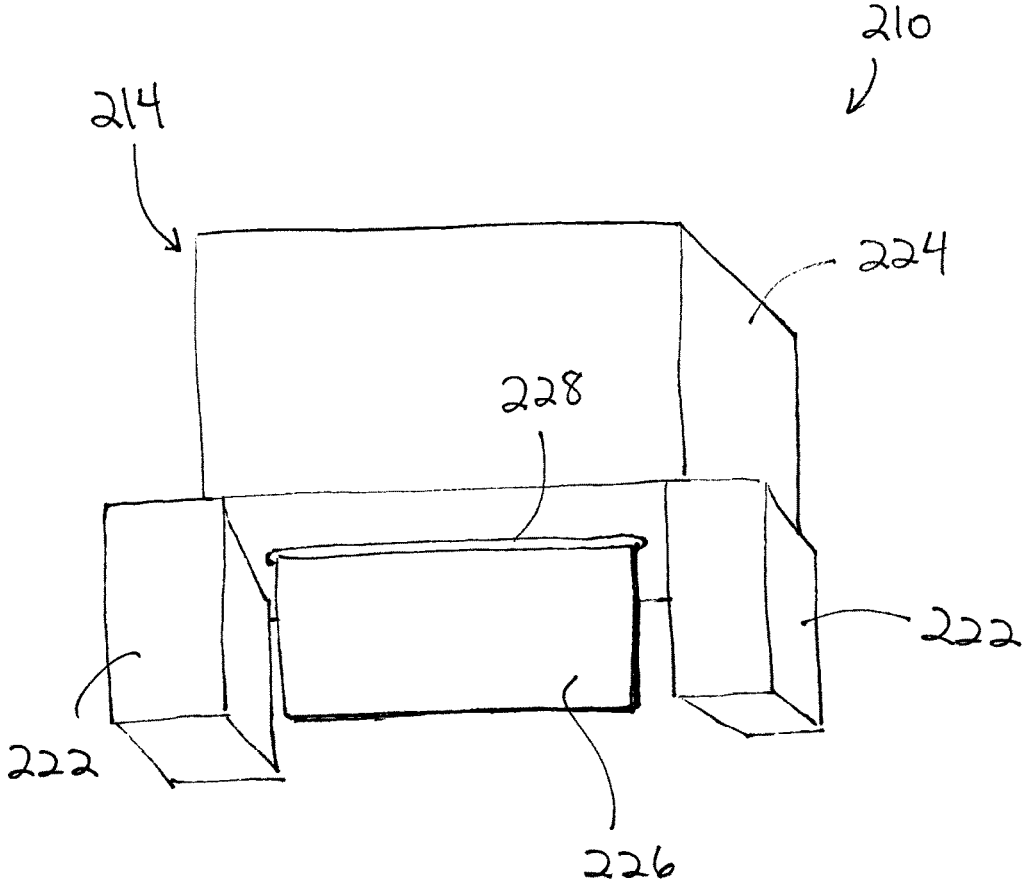
FIG. 2 is a perspective view of a game system with a barrier obstacle, according to an embodiment.

In the embodiment shown in FIG. 1, the console 14 is elevated above the path 20 by two lifts or spacers 22 (222 in FIG. 2). The lifts 22 can be integrated with the console, connected to it, or retained separate from it. For example, in one embodiment the lifts are immovably integrated with the console in one uniform, rigid piece. In another embodiment, they are removably coupled to the console, such as by lockable hinges, so that the lifts can be folded away for storage. In another example, the lifts are separate pieces that sit under the console. The lifts 22 are sized to position the console above the path 20, providing a passage for the ball under the console. In this configuration, the height of the lifts is larger than the diameter of the ball 12 to enable the ball to pass between the lifts, under the console 14. The lifts enable the game to be played on a flat surface, without needing an elevated surface that creates a hole for the ball to fall into, such as with many forms of golf.

The console or base unit 14 supports one or more moving obstacles. These obstacles are designed to move in and out of the path 20 of the ball 12, to interfere with the player's attempt to hit or roll the ball toward the target 16. In an embodiment, the console 14 is made up of two or more separable housings or spacers 24 that are joined together. In FIG. 1A, four individual housings 24A, 24B, 24C, and 24D are shown. Adjacent housings have mating or complementary shapes or features to enable the housings to fit together into a complete stack that forms the console 14. Each housing contributes some feature or support to the sensors, obstacles, or controllers that create the game system. Individual housings can be removed and replaced, for repair, upgrade, or substitution of new or different housings, to create new obstacle course challenges.

An exploded view of the four housings 24A-D is shown in FIG. 1B. The first housing 24A supports a proximity sensor 80, an LED (light emitting diode) or other light emitter 34, and an expansion port 304 (shown in FIG. 5), which will be described in more detail below. The second housing 24B acts as a spacer and support for a drawbridge obstacle, which will also be described below. The third housing 24C provides receptacles for various electronic and mechanical components, such as motors, gears, and sensors, which are utilized to drive various obstacles or features. The fourth housing 24D supports two additional obstacles, a pendulum and two rotating flippers, which will be described in more detail below. The console 14 is made up of these individual housing units, which can be mixed and matched to create consoles of various configurations. Though four housings 24A-D are shown in FIG. 1B, it should be understood that consoles may be arranged with more or fewer housings, such as one, two, three, five, or more individual housing blocks. The housings themselves may vary in size and shape, depending on the components, sensors, actuators, and obstacles that each housing supports. In an embodiment, the housings 24A-D are removably secured together to form the console 14, such that they can be removed and replaced or substituted with other housings.

As mentioned above, the console 14 operates one or more obstacles for game play. A first obstacle is shown in FIG. 2. In this embodiment, a game system 210 includes a console 214 with a single housing 224 supporting an obstacle in the form of a barrier 226 that moves into and out of the housing 224. The barrier 226 moves through an opening 228, such as a slot, in a bottom face of the housing. FIG. 2 shows the barrier in its deployed position, extending out of the housing 224 and blocking the path of the ball. The barrier 226 can be sized or shaped in various ways according to the desired game. For example, the barrier 226 can be a drawbridge, pocket door, a wall, a gate, a portcullis, or other movable structures. The barrier 226 moves in and out of the housing to intermittently block the path of the ball.

Figure 3A:
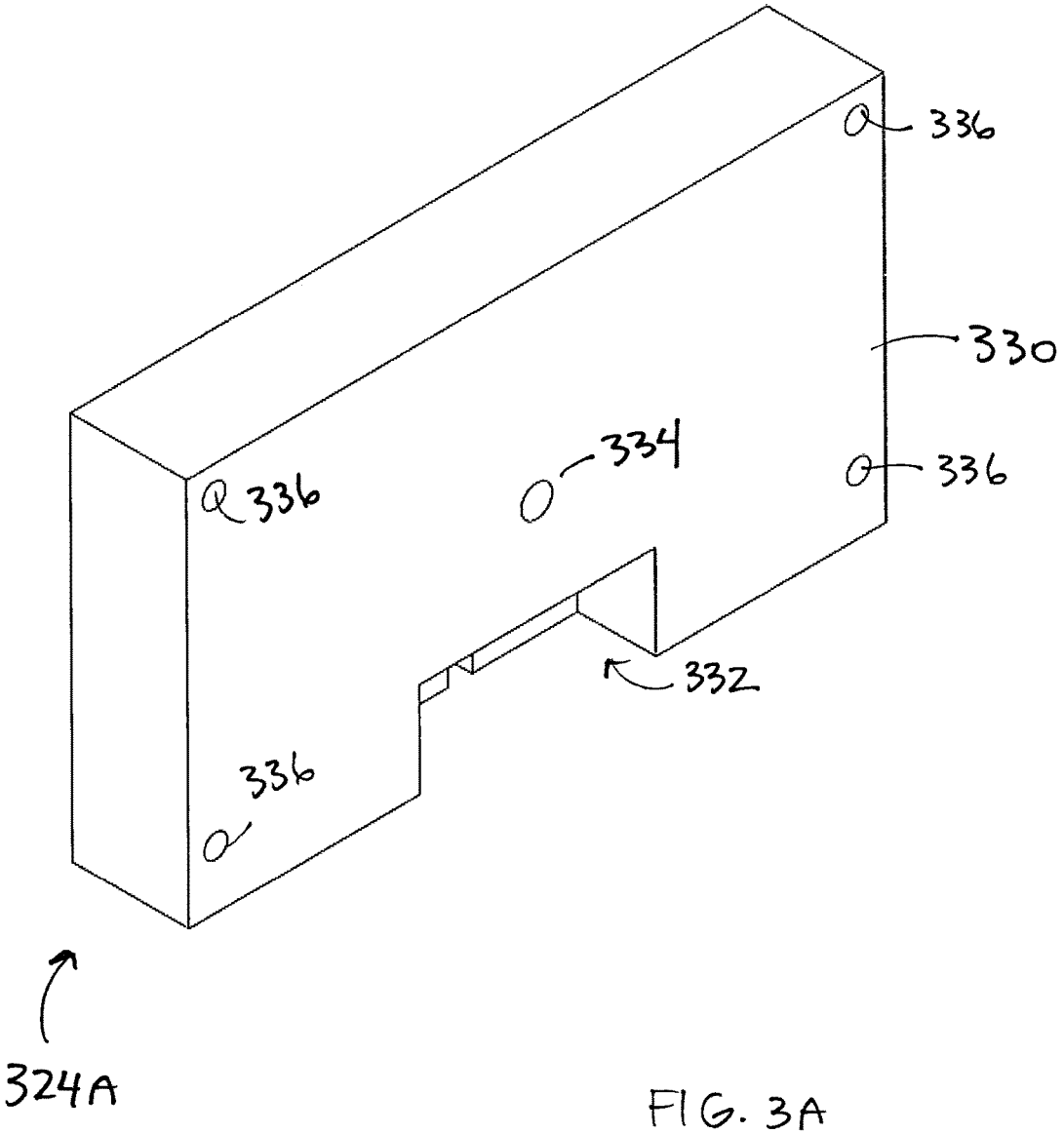
FIG. 3A is a perspective view of a first housing of a game system, according to an embodiment.

Next, four example housings 24A-D and their respective features or obstacles will be described. FIG. 3A shows a perspective view of a first housing 324A. The housing 324A is shaped as a rectangular prism with a front face 330. At the bottom of the front face is a cut-out forming a receptacle 332 for a proximity sensor (such as the sensor 80 shown in FIGS. 1A-1B). The receptacle 332 is positioned at the front and bottom of the housing 324A in order to provide the sensor 80 with a view of the path 20 for the ball (see FIG. 1A). The front face 330 also includes an LED or emitter 334, which is used to provide feedback to the user during game play, and to indicate the status of the game unit. The housing 324A also includes four holes or channels 336, one at each corner of the housing. These align with channels on the other housings 324B-D in order to receive a screw, pin, or bolt to hold the housings together. The housing 324A also supports an expansion port 304 (shown in FIG. 5) for attaching accessories such as an additional obstacle.

In the embodiment shown, the first housing 324A does not itself support an obstacle that blocks the ball's path, but supports other peripheral components for the game unit.

Figure 3B:
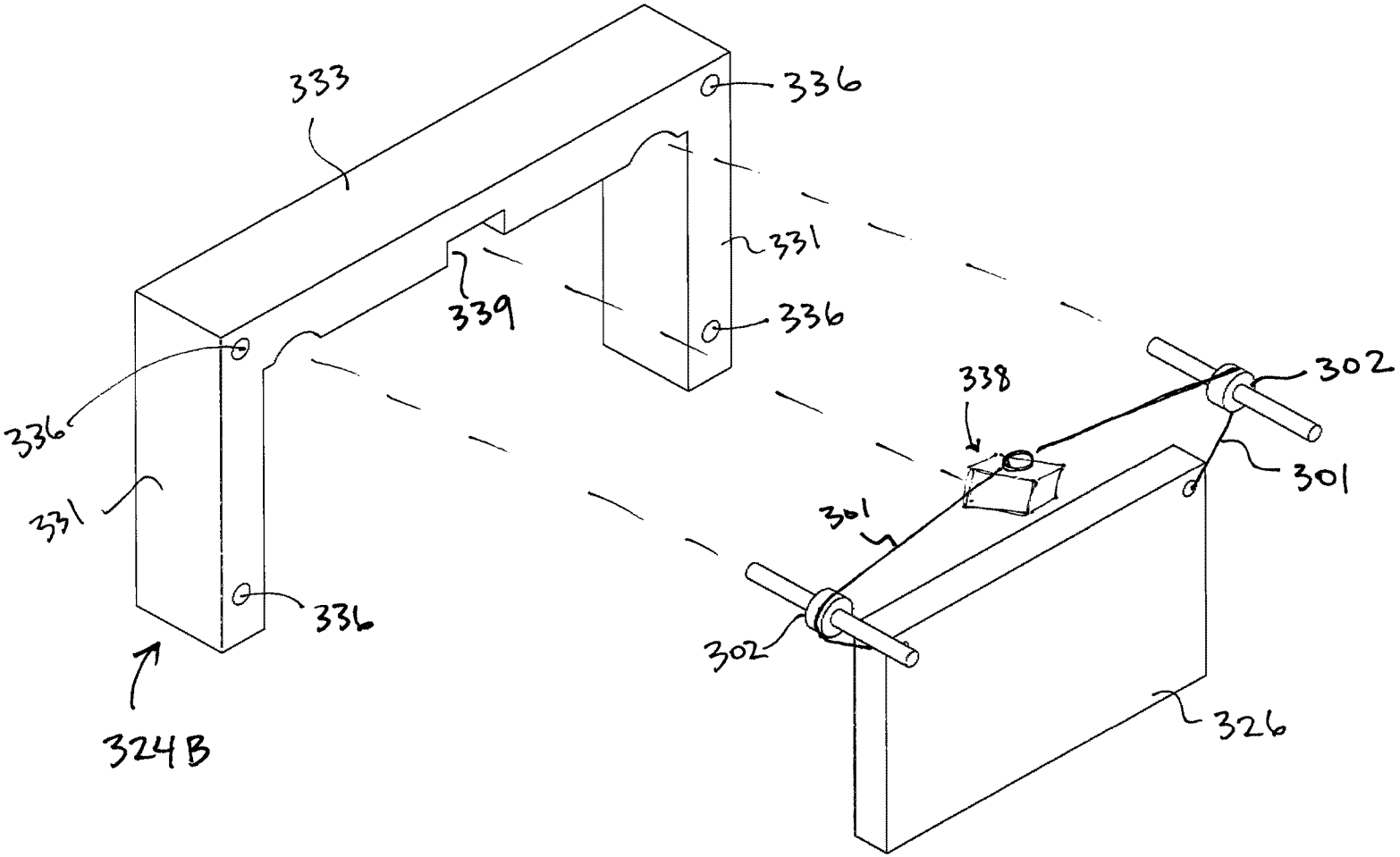
FIG. 3B is a perspective view of a second housing of a game system, according to an embodiment.

FIG. 3B shows a second housing 324B which supports a barrier obstacle 326 (similar to the barrier 226 of FIG. 2). The second housing 324B is an arch-shaped spacer with two legs 331 on either end of a roof segment 333. When the housing 324B is sandwiched between the housings 324A and 326C, the three housings together form a pocket for the barrier 326. The barrier 326 is moved up and down into and out of this pocket by a motor 338, which fits into a cutout receptacle 339 in the roof 333 of the housing 324B. The bi-directional motor 338 is connected to a string 301 (or wire, rope, or other tether), which is routed around two pulleys 302 and then connected to the barrier 326. The motor 338 runs in a first direction to unwind the string and lower the barrier 326 into the path 20 (see FIG. 1), and in the opposite direction to re-wind the string and raise the barrier 326 up out of the path and into the pocket inside the housing 324B. Other mechanisms for raising and lowering the barrier 326 can be used instead of the motor, string, and pulleys described here. For example, a motor may turn a gear to raise the barrier up a set of ratchets, and the ratchets may be released to drop the barrier. As illustrated by FIGS. 2 and 3B, the barrier can be housed in various ways, such as through a slot or opening, in a pocket, or in a space between housings.

Figure 3C:
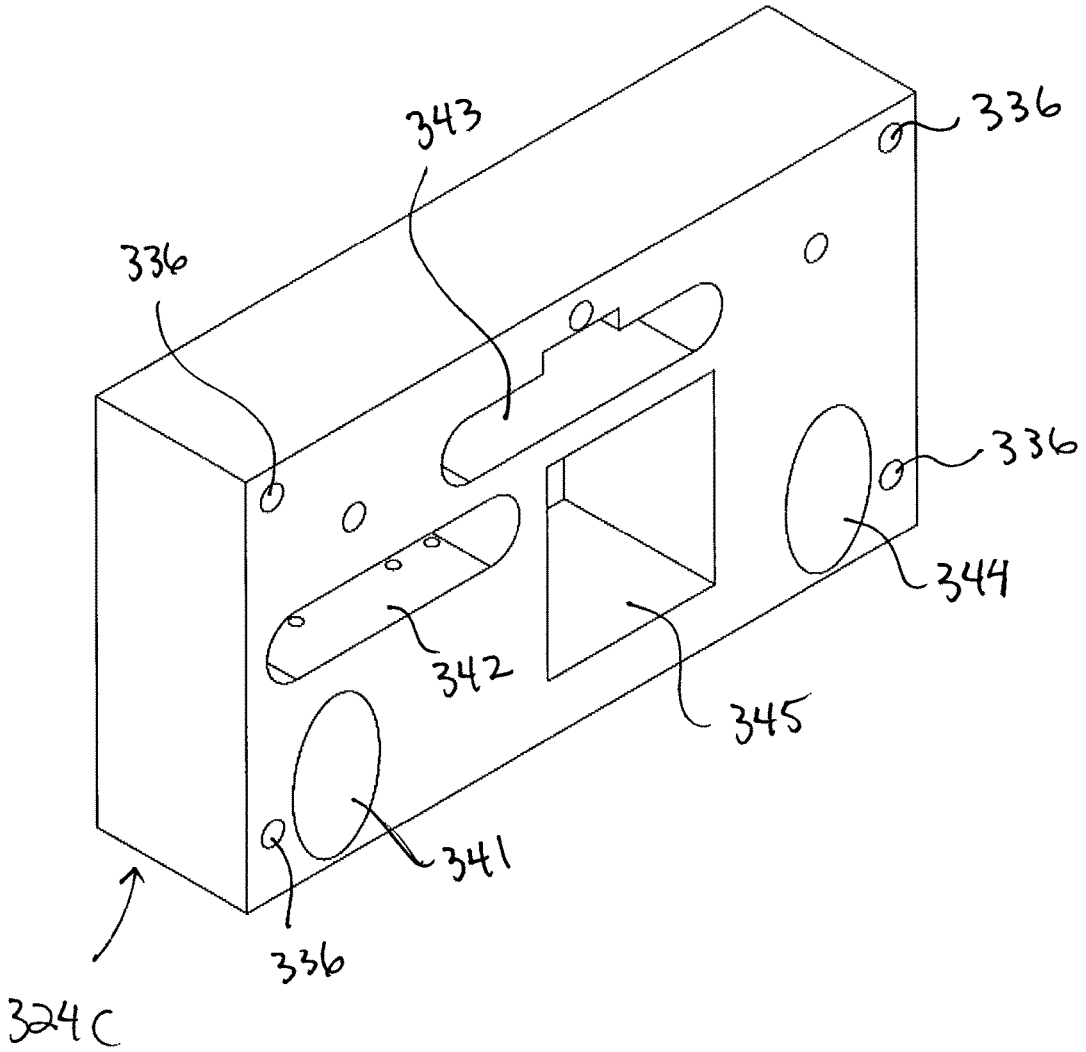
FIG. 3C is a perspective view of a third housing of a game system, according to an embodiment.

A third housing 324C is shown in FIG. 3C. This housing is a spacer and receptacle for various electronic and mechanical components, such as motors, gears, and sensors, which are utilized to drive obstacles or features in other housings. For example, the housing 324C includes cutouts or receptacles 341, 342, 343, 344, and 345, each with a different size, shape, or position on the housing. Receptacles 341 and 344 each receive a rotor obstacle, which will be described in reference to FIG. 3D. Receptacle 342 holds a motor and rotor that are used to initialize a pendulum obstacle, which will be described in further detail below. The pendulum itself and its motor are supported in receptacle 343. In an embodiment, the receptacle 343 also holds the motor 338 that drives the barrier that moves into the previous housing 324B. Finally, the receptacle 345 is empty, and is formed to reduce the weight and material of the housing 324C.

Figure 3D:
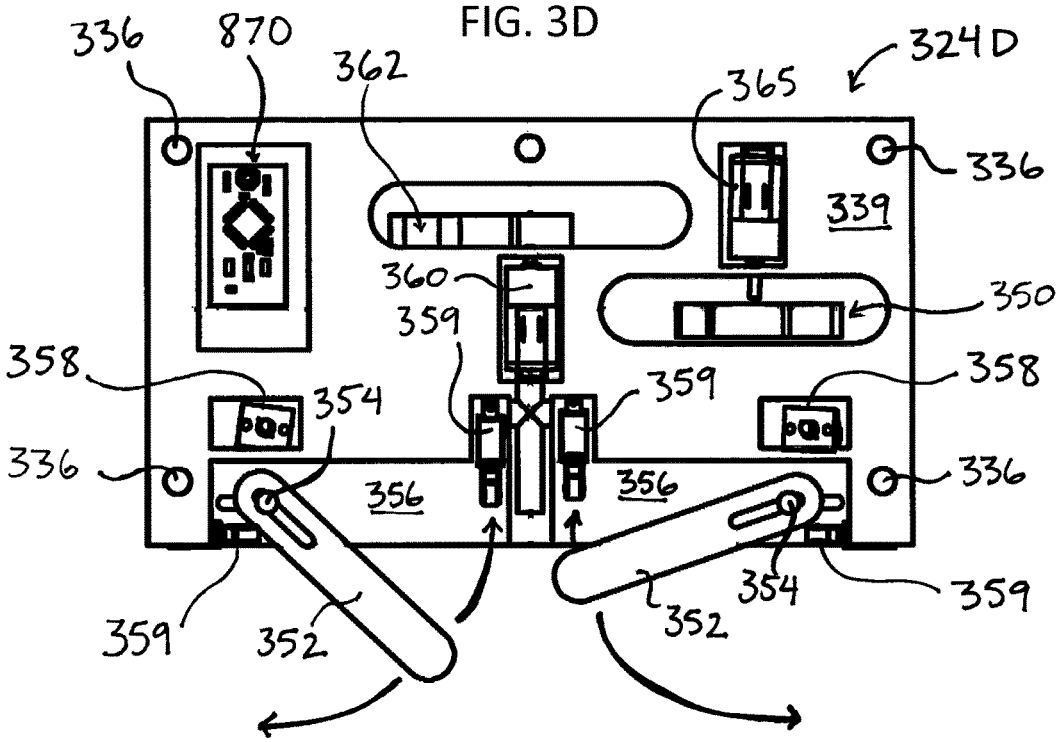
FIG. 3D is a front perspective view of a fourth housing of a game system, according to an embodiment.
Figure 3E:
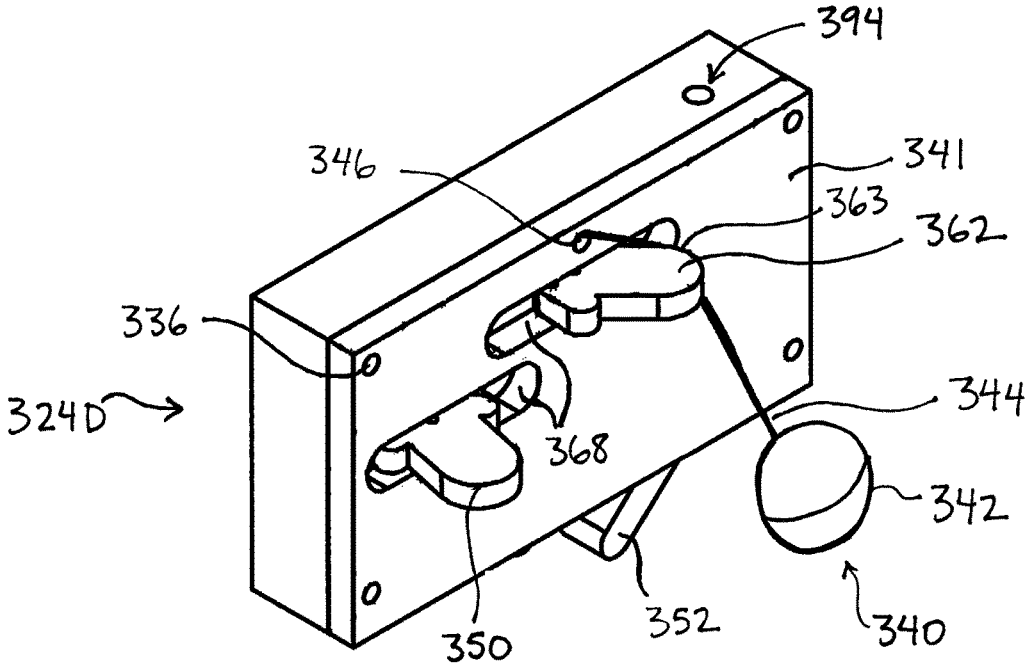
FIG. 3E is a rear perspective view of the fourth housing of FIG. 3D.

The fourth housing 324D is shown in FIGS. 3D and 3E. FIG. 3D shows the housing's front face 339, which faces toward the previous housing 324C. This fourth housing 324D supports several obstacles, including a pendulum (described below) and two rotors 350. The rotors will be described first. In the embodiment shown, each rotor includes a flipper 352 supported by a rod 354. The flippers 352 rotate back and forth within 90 degree arcs, as shown by the arrows in the figure. The flippers are received within respective receptacles or cutouts 356 at the bottom of the front face 339 of the housing 324D. Each flipper is driven by a respective motor 358, which rotates the rod 354 (via a gear connecting the motor to the rod) and thereby rotates the flipper 352 through its 90 degree arc. In an embodiment, the 90 degree arc of each flipper is bound by two end stops or touch sensors 359, one at each end of the arc. When the flipper touches or activates an end stop or touch sensor 359, the motor reverses direction and begins to rotate the flipper in the opposite direction, toward the opposite end stop 359. As long as the flipper obstacle is being operated, it can rotate back and forth within its arc, triggering the motor to reverse direction each time the flipper reaches an end stop. Each flipper rotates back and forth in opposite directions within an arc that is less than 360 degrees.

Though end stops are described in some embodiments as a mechanism to control a motor, reversing its direction when the end stop is triggered, another option is a servo motor. A servo motor can be programmed to move to a specific position and either stop or reverse. For example, within a 360 degree span of rotation, a servo motor can be programmed to move to the 90 degree position and stop, or reverse, and move to another designated position. In embodiments herein where motors and end stops are described, they may be replaced with servo motors. Additionally, even where servo motors are used, end stops may be provided as an extra backup to prevent the motor from rotating too far.

FIG. 3E shows a rear view of the fourth housing 324D, showing its rear face 341. In this embodiment, the obstacle is a pendulum 340, which includes a weight 342, such as a ball, suspended from a tether 344, such as a cord, wire, rope, or string. The tether 344 is attached to the housing 324D at a mount 346, which provides a hook or other structure to tie or glue or secure the tether to the housing. In the embodiment of FIG. 3D, the tether 344 is removably hooked to the mount 346 to suspend the weight 342 below the housing 324D. The length of the tether 344 is less than the full height of the mount 346 when positioned above the playing surface, but is long enough to position the weight 342 in the ball's path when the weight hangs straight down from the mount, as illustrated below in the embodiment of FIGS. 4A-4C.

The pendulum 340 can be allowed to free swing from the mount 346, or it can be actively pushed by a rotor 362, which in turn is rotated by a motor 360 (in FIG. 3D). The rotor 362 can be shaped as a projection, bar, hook, or ledge with a side surface 363 that pushes against the tether 344, to swing the pendulum 342 to the reader's right (in FIG. 3E). The rotor 362 reaches an end stop or touch sensor (not shown), which triggers the motor 360 to reverse direction, moving the rotor 362 away from the tether as the pendulum falls back to the reader's left (in FIG. 3E). The rotor 362 then reaches the opposite end stop or touch sensor, and the motor reverses again, moving the rotor 362 against the tether to swing it again. The motor 360 rotates the rotor 362 between the two end stops to repeatedly push the pendulum through its arc, swinging the weight 342 across the ball's path. The surface 363 is indicated on one side of the rotor 362 (in FIG. 3E) but can be alternatively or additionally on the opposite side (the left side in FIG. 3E), so that the rotor 362 pushes the pendulum from the other side of the rotor.

Still referring to FIG. 3E, the fourth housing 324D also supports a trigger 350 that can be used to release the pendulum from a raised position. The trigger 350 includes a rotor that is similarly rotated, by a motor 365 (in FIG. 3D) between end stops or touch sensors (not shown). The trigger 350 can be held stationary in a first position, extending out from the housing 324D, as shown in FIG. 3E, and the pendulum can then be draped over the trigger 350 to hold the pendulum in a raised position. The trigger is then rotated toward end stop to withdraw the trigger from the pendulum's path, releasing the pendulum to swing freely. This operation is described further in the embodiment of FIG. 4A-4C. In an embodiment, the rotors 350 and 362 overlap, so that the pendulum can be transferred from one to the other, such as from the rotor 362 over to the trigger 350 to set the pendulum in place. In FIG. 3E, the rotor 362 and the trigger 350 and their respective end stops fit into receptacles or cutouts 368 formed in the housing 324D. The rotor 362 and trigger 350 can each be fully enclosed and held inside its respective cutout 368 when rotated against one of the respective end stops. FIG. 3E also shows accessory port 394 which is a connector or port for electrical connection to an external device. For example, in an embodiment, the port 394 is a USB port (such as USB port 894 discussed below) or an audio jack.

Figure 4A:
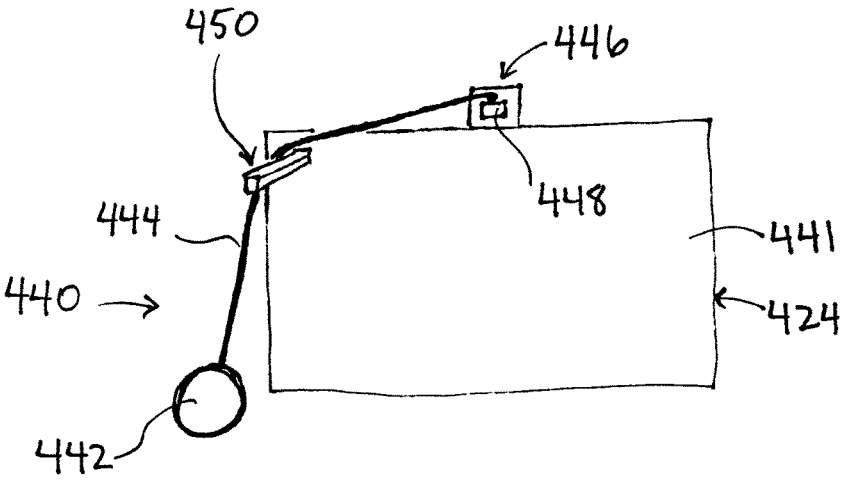
FIGS. 4A-C show a rear view of a game system with a pendulum obstacle, in various stages of operation, according to an embodiment (with some features omitted for clarity).
Figure 4B:
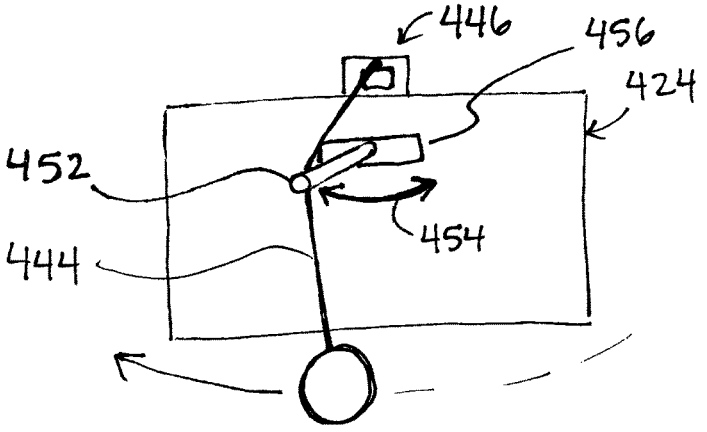
Figure 4C:
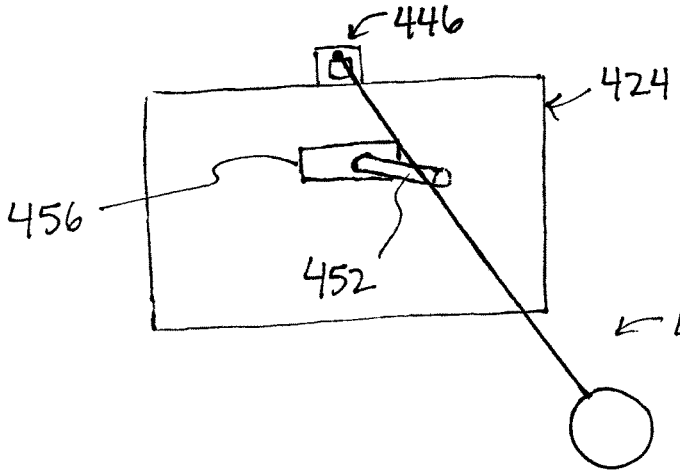

FIG. 4A-4C show operation of a pendulum obstacle 440, according to an embodiment. The pendulum 440 may be used as a free swinging pendulum, or may be operated by a motor. In the embodiment of FIG. 4A, the pendulum 440 is utilized as a free swinging pendulum, in which it swings freely without input from a motor or other energy source. The pendulum 440 includes a tether 444 and a weight 442, and the tether is secured to the housing 424 at a mount 446. In this embodiment, the mount 446 sits on top of the housing 424 and is shaped as a crane with an arm 448 that extends out past the rear face 441 of the housing (also shown in FIG. 4D). The pendulum 440 can simply be lifted and released by a player to allow the pendulum to swing on its own, or it can be hooked around a trigger or catch 450 that projects out from the housing 424 to hold the pendulum in an initial, raised position. The catch 450 is a projection such as a hook or peg that holds the tether in the position shown in FIG. 4A. In an embodiment, the catch 450 is coupled to an actuator that releases the catch upon a timer or user input, withdrawing the catch 450 into the housing 424 and thereby releasing the pendulum to swing from the mount 446. In another embodiment, the catch 450 is spring-loaded, and when it is released, a spring or other biasing member withdraws the catch back inside the housing 424. The catch 450 will be described in further detail below in reference to a mode of play.

In the embodiment of FIGS. 4B-4C, the pendulum is actively pushed by a motor to maintain a swinging motion. The motor, inside the housing 424, rotates an arm 452 back and forth through an arc 454. The arm 452 connects to the motor through an opening 456 (such as a slot) in the housing. Referring to FIG. 4B, when the arm 452 moves to the reader's left, it pushes the tether 444 to swing the pendulum to the left. When the arm 452 moves to the right, it moves at a fast enough speed to allow the pendulum to swing freely behind it, until the arm stops at the far right end of the arc (as shown in FIG. 4C). From there, the arm moves back to the left, again pushing the tether. In this way, the arm pushes the tether in one direction with each cycle of the arm through its arc, causing the pendulum to keep swinging. The speed of the motor controlling the arm 452 can be adjusted, as can the degree of span of the arc 454, to control the range of the pendulum 440. For example, the span of the arc 454 can be increased to raise the pendulum to a higher endpoint and cause the pendulum to swing through a greater distance, or it can be decreased to reduce the distance through which the pendulum swings.

Figure 4D:
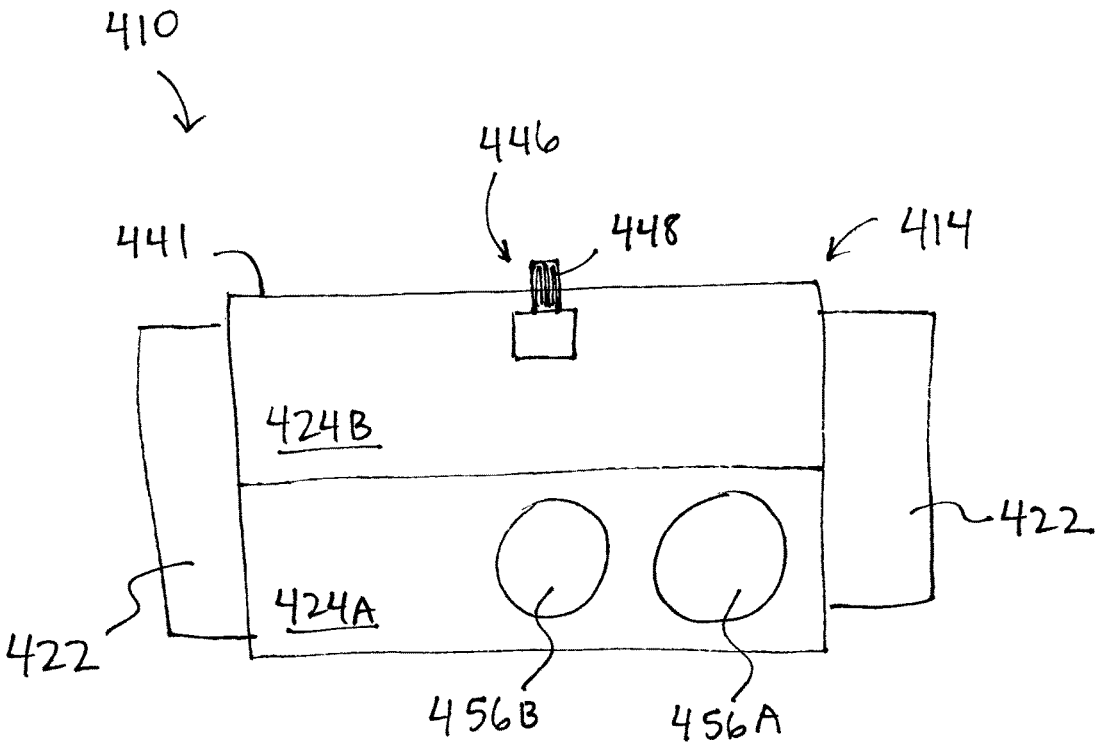
FIG. 4D shows a top view of the game system of FIGS. 4A-C.

A top view of a game system 410 with a console 414 formed from two housings 424A, 424B is shown in FIG. 4D. This view illustrates the position of the mount 446 and its arm 448 extending past the rear face 441 of the housing 424B. The spacers 422 are also shown, lifting the console above the playing surface. In this embodiment, the housing 424A also includes two apertures 456A and 456B on the top face of the housing. These are receptacles for the pendulum 440 and mount 446, respectively, so that the pendulum and mount can be removed from the housing and stored compactly with the housing when the game is not in use. The pendulum fits inside receptacle 456A, and the mount 446 (with arm 448) fits inside receptacle 456B. The receptacles may include clips or hooks to retain the pendulum or mount inside the receptacle. Optionally, one or more lids may cover the receptacles.

Figure 5:
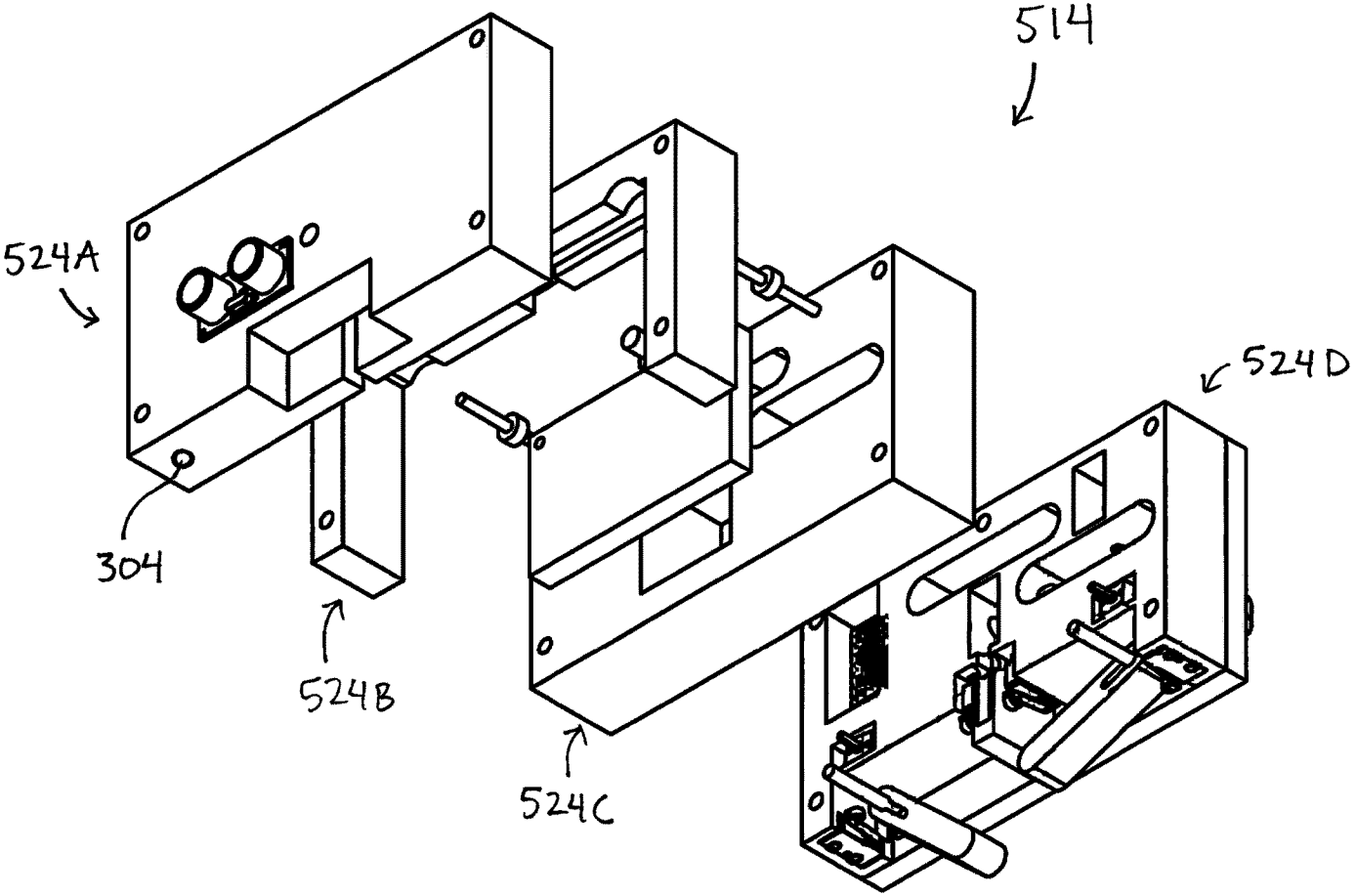
FIG. 5 is an exploded perspective view of a game console with four housings, according to an embodiment.

FIG. 5 shows a bottom exploded view of a console 514 with all four housings 524A-D and some of the components and obstacles they support. When the housings are stacked together, it is clear that the different obstacles they support move in different planes, creating a three-dimensional obstacle course. In an embodiment, the different planes are parallel. In another embodiment, the planes in which the obstacles move are not all parallel (for example, in FIG. 7, the flipper 750 can rotate forward and back, in a horizontal plane, instead of up and down in a vertical plane). When a game system such as this system includes more than one obstacle, the movements of these obstacles can be coordinated and timed to provide varying degrees of difficulty in passing the ball through or past the console. Examples of various modes of game play are described in further detail below.

Figure 6A:
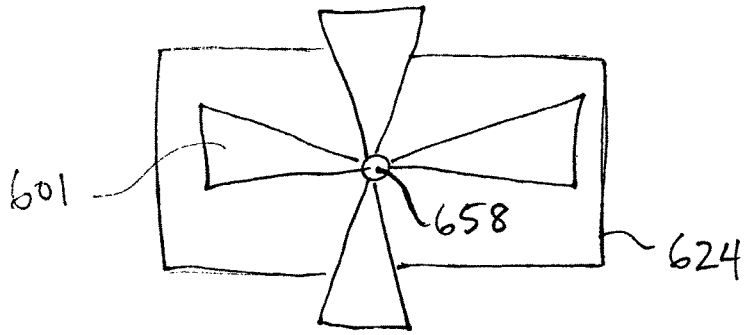
FIG. 6A is a rear view of a game system with a windmill obstacle, according to an embodiment.
Figure 6B:
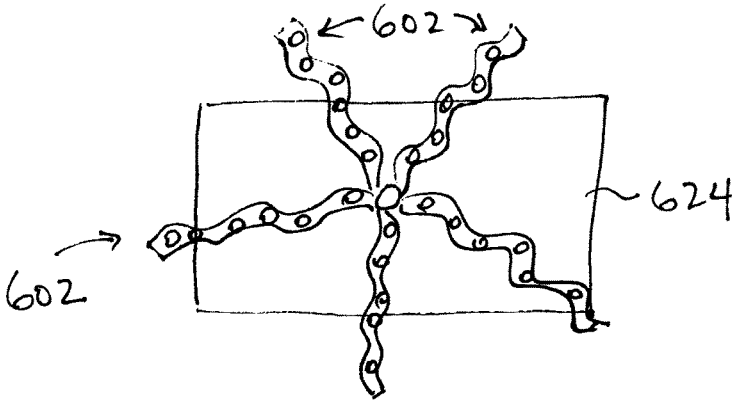
FIG. 6B is a rear view of a game system with a tentacle windmill obstacle, according to an embodiment.
Figure 6C:
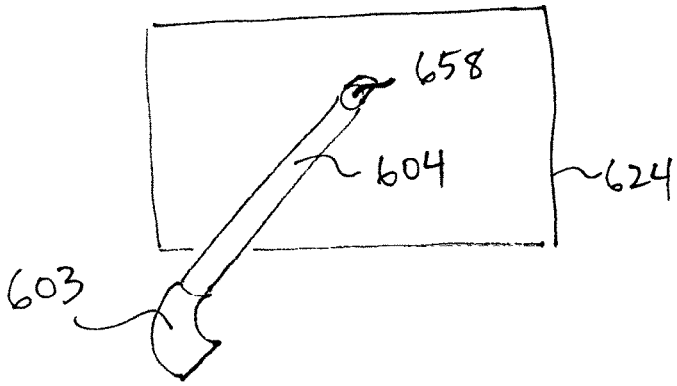
FIG. 6C is a rear view of a game system with a cup obstacle, according to an embodiment.

Many different types of obstacles can be supported by the console to provide a variety of modes of play, difficulty levels, and game themes. Various obstacles are illustrated in FIGS. 6A-6C as examples. In FIG. 6A, the obstacle is a rotor in the form of a windmill 601, which is supported by a shaft 658 that is rotated by a motor inside the housing 624. The shaft rotates the windmill such that the blades of the windmill move in and out of the ball's path. The shaft rotates the windmill continuously in the same direction through 360 degrees. In FIG. 6B, the windmill has been removed and replaced with a set of tentacles 602, which are also rotated by the shaft. The tentacles 602 can be utilized along with other obstacles that have a shared theme, such as a nautical/ocean/pirate theme, or themes based on ancient mythologies, popular movies or television shows, or other examples. In other embodiments, the tentacles are removed and replaced with other rotating elements, such as dragon claws or tails (which can be used along with a dragon theme), animal arms or feathers (for an animal/jungle theme). Other portions of the game system, such as the housing and the spacers, can also be configured to match the theme. For example, the housing can be shaped and decorated like a castle, and the spacers decorated to indicate that the path between them is a moat, and the pendulum can be a spiked ball resembling a mace. It will be apparent to the reader that many other themes or artistic elements can be employed to configure the base unit, spacers, and obstacles (mini golf, baseball, basketball, animal characters, fictional stories, and others). The components of the game system can share a theme to create a story or game mode, and the components can be switched and replaced to create new themes and stories for a variety of game play.

In other embodiments, the obstacles are intended to be struck by the ball, instead of avoided, as shown for example in FIG. 6C. In this embodiment, the obstacle includes a cup 603 at the end of an arm 604 that is rotated by the shaft 658. In this configuration, the goal is to hit the ball into the cup 603, which then either catches and lifts the ball, or deflects it in a new direction toward another obstacle or target.

Figure 7:
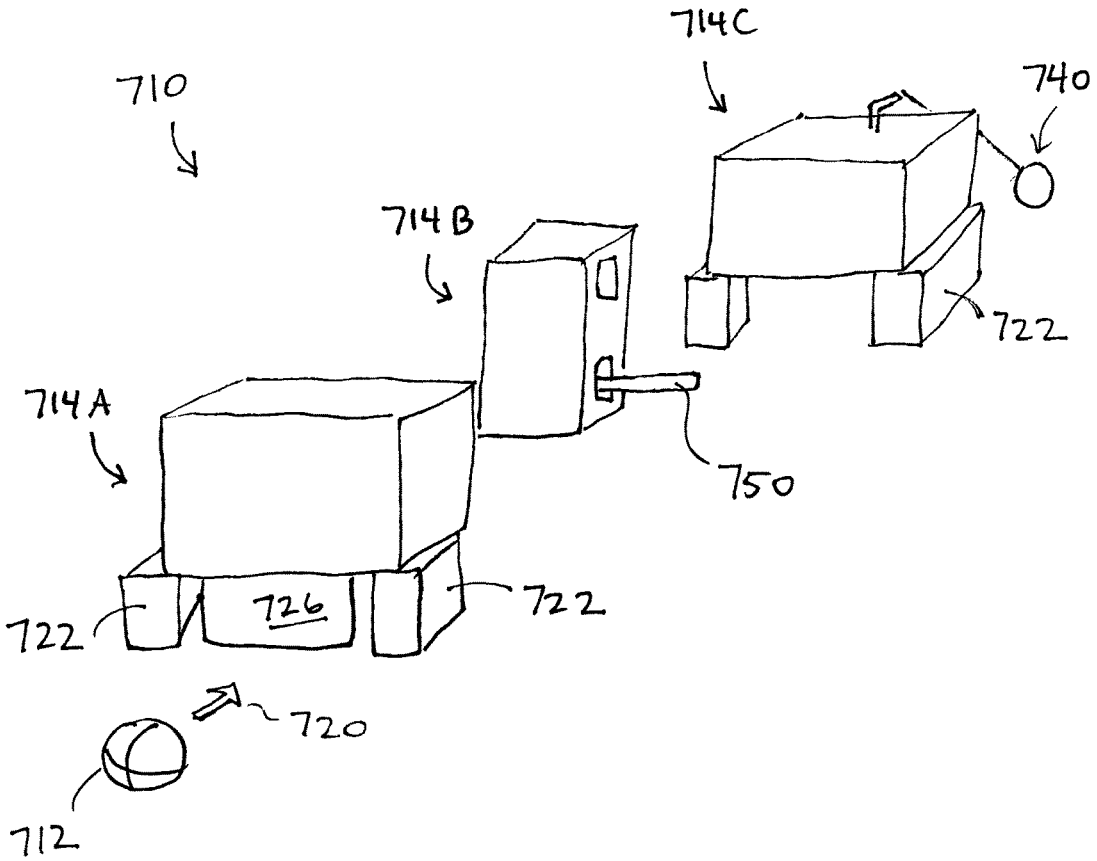
FIG. 7 is a perspective view of a game system with multiple consoles, according to an embodiment.

In other embodiments, multiple game units can be arranged to create a longer obstacle course, as shown for example in FIG. 7. In the embodiment of FIG. 7, a game system 710 includes three game units 714A, 714B, and 714C that are arranged in series, positioning their respective obstacles in the path 720 of the ball 712. The first game unit 714A deploys a vertical barrier 726 (such as a wall). The second game unit 714B deploys a flipper 750, and the third game unit 714C deploys a pendulum 740. The second game unit 714B is placed on its side, without spacers 722. This arrangement shows the versatility of the game units and the many ways they can be configured to provide new and unique obstacle courses for the ball. The three game units can be arranged in a different order, the second game unit 714B can be positioned on spacers instead of on its side, and other changes can be made to create an entirely new obstacle course.

Additionally, objects in the surrounding environment can be incorporated into the game. For example, referring back to FIG. 1, the game system 10 utilizes an external target 16 placed behind the console or base unit 14. The external target 16 can be a dedicated part of the game system (for example, a foam square that is sold with the game system) or any available element in the surrounding environment (such as the leg of a chair, or a book, cup, open doorway, shoe, or other items). Players can create their own games by arranging one or more base units and obstacles along with environmental items to create a custom obstacle course. As an example, a base with a windmill (such as 601 in FIG. 6A) can be positioned in front, then a base with a cup (such as cup 603 in FIG. 6C), which actually diverts the ball 90 degrees toward a chair leg that represents the target. The players attempt to hit the ball past the windmill and into the cup, which then rolls the ball toward the chair leg.

Figure 8:
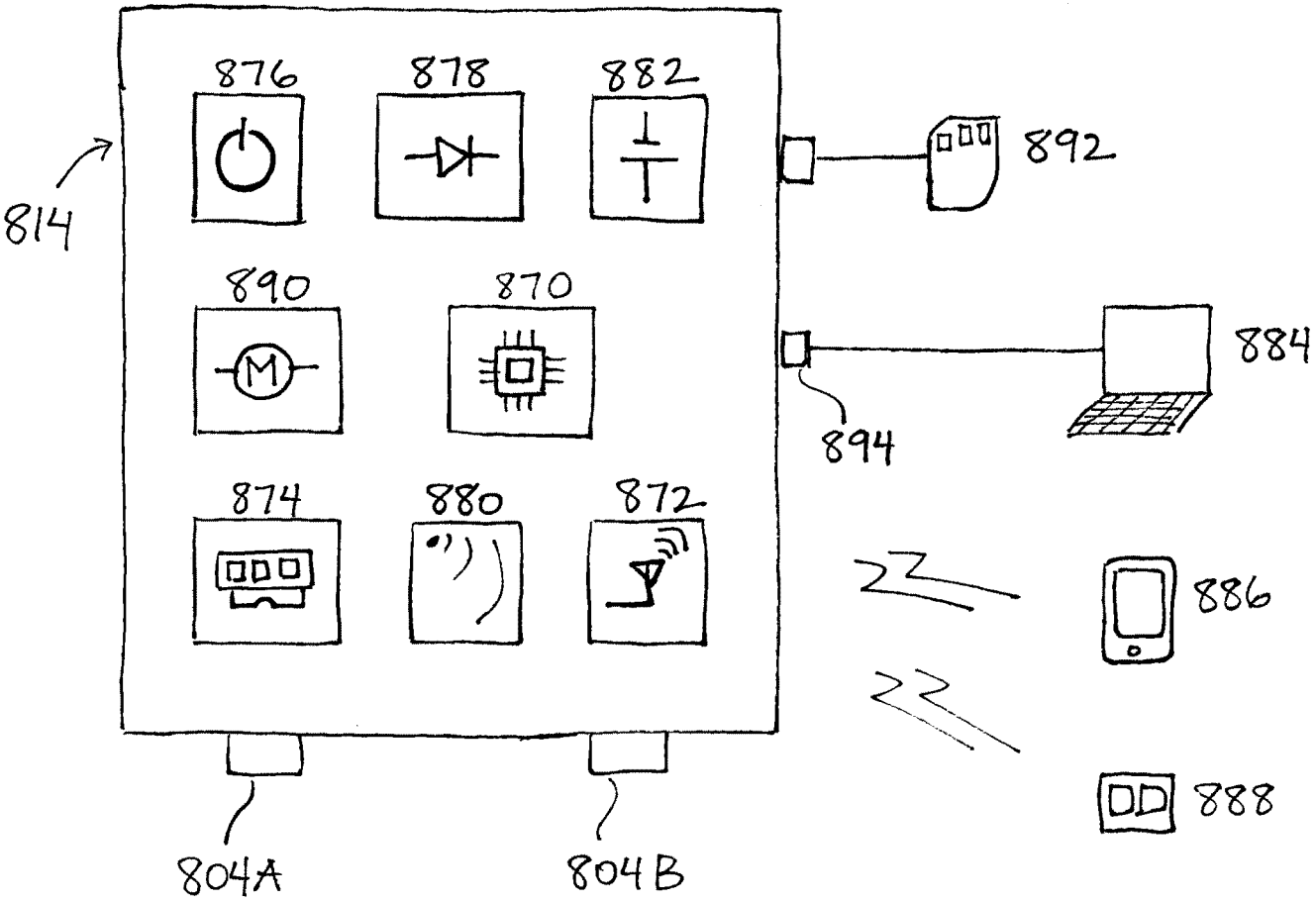
FIG. 8 is a block diagram of components of a console and communication with external devices, according to an embodiment.

A block diagram of various electrical and electro-mechanical components within the console 814 is shown in FIG. 8. The block diagram shows a power button 876, light emitter (such as an LED) 878, on board battery 882, motor (representing one or more motors or actuators) 890, microcontroller 870, on board memory 874, and sensor (such as proximity sensor) 880. The microcontroller 870 controls the various motors, switches, sensors, and actuators via wired and/or wireless connections, such as through the wireless transceiver 872. An example motor is the Micro Gearmotor (460 RPM) from Pololu Corp. (Las Vegas, Nev.). The microcontroller 870 is connected to the memory 874, which may be integrated with the microcontroller or a separate component. The memory can be stored inside the console 814 (such as inside one of the housings), may be removable (such as an SD card 892), or may be external memory that sits outside the housing and connects to the microcontroller. The power switch 876 interacts with a physical button or switch for the user to turn the device on and off, and an optional internal battery 882. Although not shown, a connector can be provided to connect the unit to a power outlet for AC (alternating current) power. The light emitter 878 can be operated to indicate the status of the base unit, such as light solid on (device is on and working), light blinking (device is receiving user input), light off (device is turned off).

The sensor 880 can be positioned physically on the console (such as console 14 in FIG. 1) and utilized depending on the purpose of the sensor. In an embodiment, the sensor is a motion or proximity sensor that detects the approach of the ball 20. For example, in FIG. 1, a proximity sensor 80 is positioned on the front face of the housing 24. The proximity sensor 80 faces forward and detects movement of the ball 12 along at least a portion of the path 20. The sensor 80 communicates with the microcontroller 870, which can take any of a variety of actions based on the output of the sensor 80. For example, when the sensor outputs a signal detecting the approaching ball, the microcontroller can activate a computer opponent to operate the obstacles in game play against a player. For example, the microcontroller can deploy an obstacle, such as the barrier (see barrier 226 in FIG. 2) when the sensor 80 detects the approach of the ball 12. Examples of a proximity or motion sensor include ultrasonic sensors, capacitive sensors, photoelectric sensors, other electromagnetic distance sensor, and other options. An example of a suitable ultrasonic sensor is the Ping sensor from Parallax Inc. (Rocklin, Calif.).

FIG. 8 also illustrates the options for communicating with external components such as a personal computer (PC) 884 (through accessory port 894, such as a USB port), smart phone or tablet 886, or remote control 888 (or a small clicker or other handheld device or controller with inputs, such as operable buttons). The PC, smartphone, tablet, or remote can communicate wirelessly with the microcontroller. These devices will be described in more detail below, after describing some modes of play.

The microcontroller 870 is also connected to two expansion ports 804A, 804B that can be used to connect additional accessories or obstacles to the game unit. For example, in an embodiment, the ports 804A, 804B are mechanical receptacles for receiving a mating connector from an accessory device. The mechanical receptacles include electrical pins that connect to corresponding pins or wires inside the connector, to electrically connect the accessory device to the port. An example is an Ethernet port, such as a Category 5 port. In turn, the port is connected to the microcontroller through a wired or wireless connection so that the microcontroller can communicate with the accessory. In another embodiment, accessory devices can communicate wirelessly with the microcontroller without utilizing the ports. Examples of accessory devices include graphic displays (such as an LCD screen, perhaps displaying a running score for the player or players), aesthetic features (such as LED lights), audio components (such as speakers), and other add-on devices.

Figure 9:
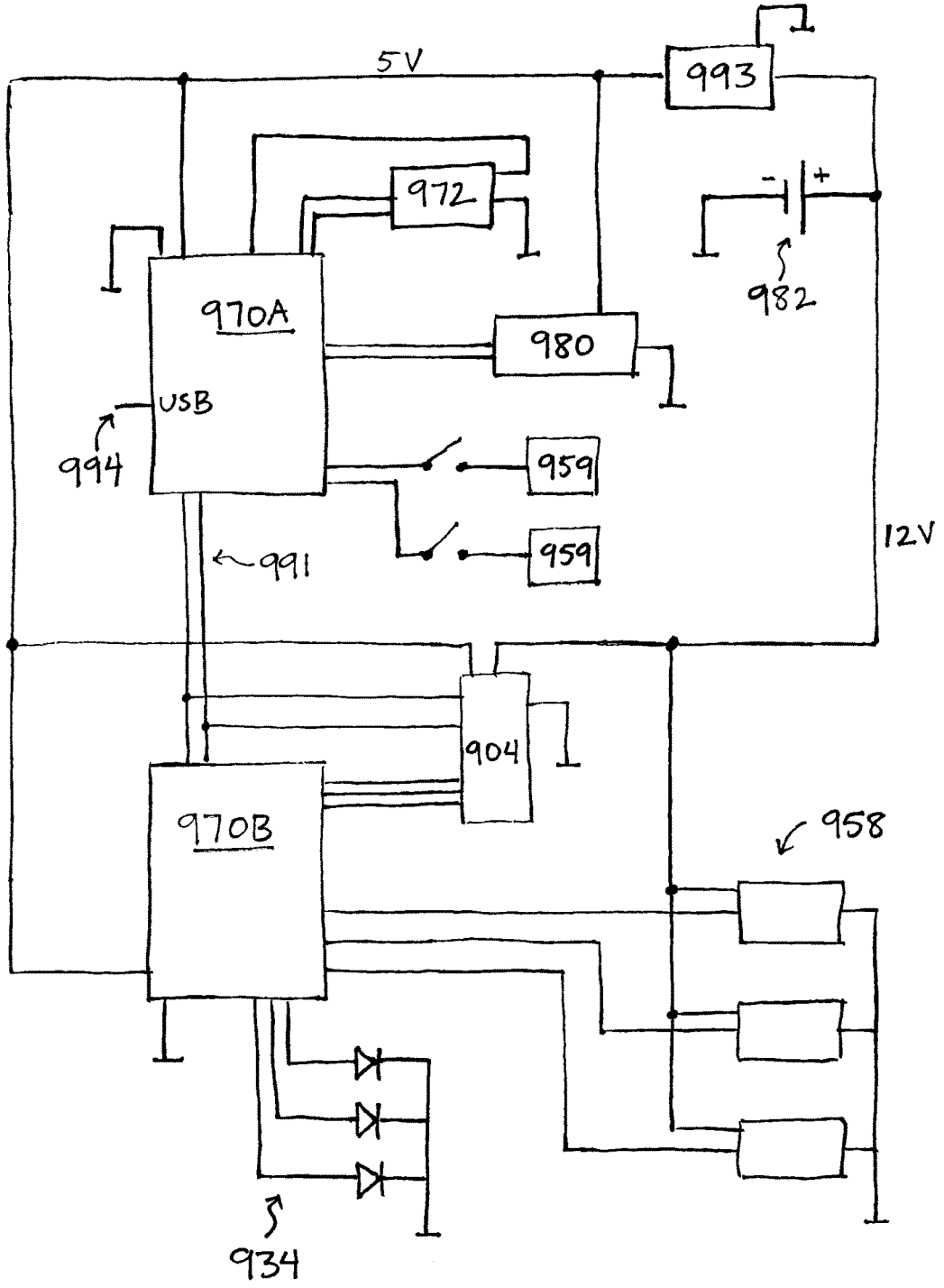
FIG. 9 is an electrical schematic for a console, according to an embodiment.

An electrical schematic according to an embodiment is shown in FIG. 9. In this embodiment, the system includes two microcontrollers 970A, 970B connected by wires 991, which may be an I2C serial connection (a two-wire serial protocol). The microcontroller 970A includes a USB port 994. The microcontroller 970A connects to a sensor 980 (such as proximity sensor), two end stops 959 (only two shown, but there may be more or fewer), and a wireless transceiver 972 (such as a WiFi module, as an example, the ESP8266 module from Espressif Inc. (China)). The microcontroller 970B connects to a set of LED's 934 (three are shown, such as red, green, and blue, but there may be more or fewer), actuators 958 (such as servo motors; three are shown but there may be more or fewer), and an expansion port 904 (such as an Ethernet port). The expansion port 904 can pass power and serial communications through to another device, such as an extra motor (operating a different obstacle), an additional light, or a different sensor. The circuit also includes an on-board battery 982, and a voltage converter 993, which converts the 12V from the battery 982 into a 5V line (indicated at the top of the figure), which some on-board components require. For example, the 12V power line is passed to the servo motor 958, while the 5V line passes to the microcontrollers 970A, 970B and the sensor 980. Both power lines feed to the expansion port 904 so that either can be passed on to an attached device.

The microcontrollers each include a processor (a chip or central processing unit (CPU)) mounted on a circuit board. The microcontrollers drive the interactions between the instructions (received from a user or programmed on a chip) and the physical components such as the motors and LED's. A suitable microcontroller is available from Arduino (Arduino LLC, Massachusetts), such as the Arduino Uno R3, a physical input/output board operating an open-source computing platform. In an embodiment, the microcontroller 970A is an Arm Cortex CPU, and the microcontroller 970B is a PCA9685 chip (NXP Semiconductors, Netherlands) that adds more channels for pulse width modulation control of the servo motors 958.

A few examples of game play will now be described. In a first example, the game is played in single-player mode. In this mode, the player can select a difficulty level, such as easy/beginner, medium, or difficult/expert. The microcontroller is programmed to operate the obstacles according to the difficulty level, such as by moving the windmill at a slow speed for the easy level, faster for the medium level, and even faster for the difficult level. As another example, the computer may operate only one obstacle at a time for the easy level (for example, turning off the windmill when the barrier is being operated), two obstacles for the medium level (intermittently deploying the barrier while the windmill spins), and three obstacles for the difficult level (deploying the barrier, flappers, and windmill at various frequencies or speeds). If desired by the user, the microcontroller can also play in a mode where it makes sudden unexpected moves, to keep the user guessing. The player can also download additional new programs to the microcontroller as discussed in more detail below.

Figure 10:
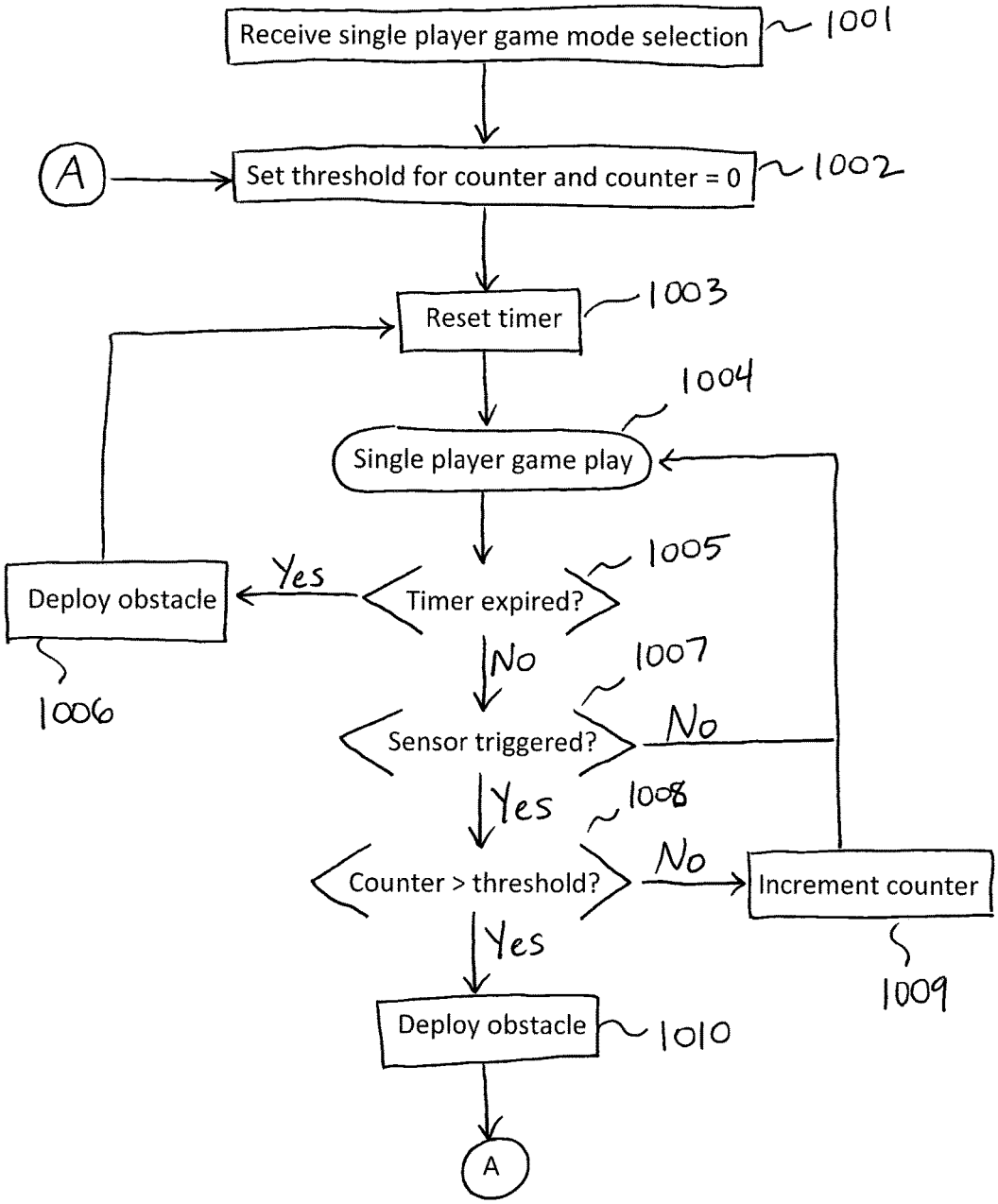
FIG. 10 is a flowchart of a method for single player game play, according to an embodiment.

FIG. 10 shows a method for operating a single player game mode, with a computer opponent that provides a degree of random or arbitrary difficulty. The method includes receiving a single player game mode selection at 1001. This could be received when the user presses a button to indicate single player mode. The method includes setting a threshold for a counter and setting the counter to zero, at 1002, and then resetting a timer at 1003. In an embodiment, the threshold for the counter is set randomly, or pseudo-randomly, below a certain maximum—such as arbitrarily set between 1 and 5. The method then moves into single player game play at 1004. At this point, depending on the difficulty level or other options, the game may begin to deploy one or more obstacles, and the player attempts to pass the ball through the path. During game play, the timer counts down, and the method depends on the timer status at 1005. If the timer has expired, then the method includes deploying the obstacle at 1006 and returning to re-set the timer at 1003. Through this logic, the method periodically deploys the obstacle at 1006, and the player can attempt to pass the ball through the course by avoiding that obstacle.

If the timer has not expired, the method checks whether a sensor has been triggered at 1007. This could be the ultrasonic sensor described above, which detects the approach of the player's ball toward the game module. If the sensor is not triggered, the method continues in single player game play. If the sensor is triggered, the method includes checking the counter at 1008. If the counter is below the threshold, then the counter is incremented at 1009 and the method returns to 1004. If the counter is above the threshold, then the obstacle is deployed at 1010 and the method returns to 1002. Through this logic, the method provides a random element to the obstacle. The obstacle is deployed based on a timer at 1006, but also at 1010 based on the counter, which was arbitrarily set at 1002. For example, if the counter is set to 2, then the third time the sensor is triggered—such as the third time the player attempts to pass the ball through the course—the method deploys the obstacle at 1010. Because the counter threshold is set arbitrarily or randomly at 1002, the player does not know when the sensor will trigger the obstacle. This provides a level of unpredictability to the single player game mode. In other embodiments, a method for single player game play includes other logic for providing a random or unpredictable game play.

In another example, the game is played by two or more players taking individual turns. For example, two (or more) players can play a game of "HORSE" in which the second player is assigned a letter (starting with "H" and spelling "horse") each time he or she does not make the same successful shot as the first player. The player that spells "horse" first loses the game. Alternatively, points can be awarded for successful shots, and the game can be scored like volleyball, where the first player to reach 21 points wins, as long as he or she wins by 2 points or more. Two or more players can also play the game like regular golf, by setting up an obstacle course, and then counting the number of shots required by each player to get the ball through the obstacles or to a target. Then the game can be re-configured in to a new "hole," and the player with the lowest score after 9 or 18 (or other number) of "holes" wins. One player can even play with a handicap, in which the difficulty of the obstacles is increased or decreased to accommodate that player.

In another example, the game is played in battle mode, in which two or more players directly interact during a single turn. For example, while Player 1 is putting or rolling the ball, Player 2 is in control of the obstacles, and can choose when to deploy them. Player 2 tries to time the obstacles to block Player 1's ball, such as by deciding when to press a button to release the pendulum to swing the pendulum across the path. Players can play each other directly in this mode, and can choose which obstacles and levels of difficulty they want to use. Optionally, other elements of unpredictability can be added to the game, such as an option in which the computer is programmed to occasionally disregard Player 2's command, so that an obstacle is not deployed when requested, or is deployed at a slower speed or with a delay. When this happens, the game unit can provide feedback to the players such as by flashing the LED red, or sounding a siren or some other sound. As another example, Player 2 can have a "power up" option that enables the player, for a limited span of time, to deploy multiple obstacles at once, or increase the difficulty of one of them (for example, increase the speed of the windmill or the duration of deployment of the barrier). Player 1 can also have a "power up" that suspends all obstacles for a short span of time. As another example, the computer can also be an active player during this battle mode, and can decide on its own to deploy or suspend obstacles. The LED or speaker (or other feedback) can signal that one or more obstacles are being controlled by the computer, such as by illuminating the LED in yellow or another color, or sounding a beep. Players can win points by blocking the ball or successfully hitting the ball passed the obstacles. Several players can play together by operating different obstacles and taking turns putting or rolling the ball.

The LED on the console can be used for a red light/green light game play. For example, when the LED is red, the player waits to start. When orange, the player can drop their ball and get in position. When green, the player may shoot. The console may be programmed to wait to deploy the obstacles until a set duration (such as a few seconds) after the green light illuminates. As another example, when the light is red, the player waits to start. When the light turns orange, the player may begin to shoot without obstacles, and when the light turns green, the obstacles deploy.

Figure 11:
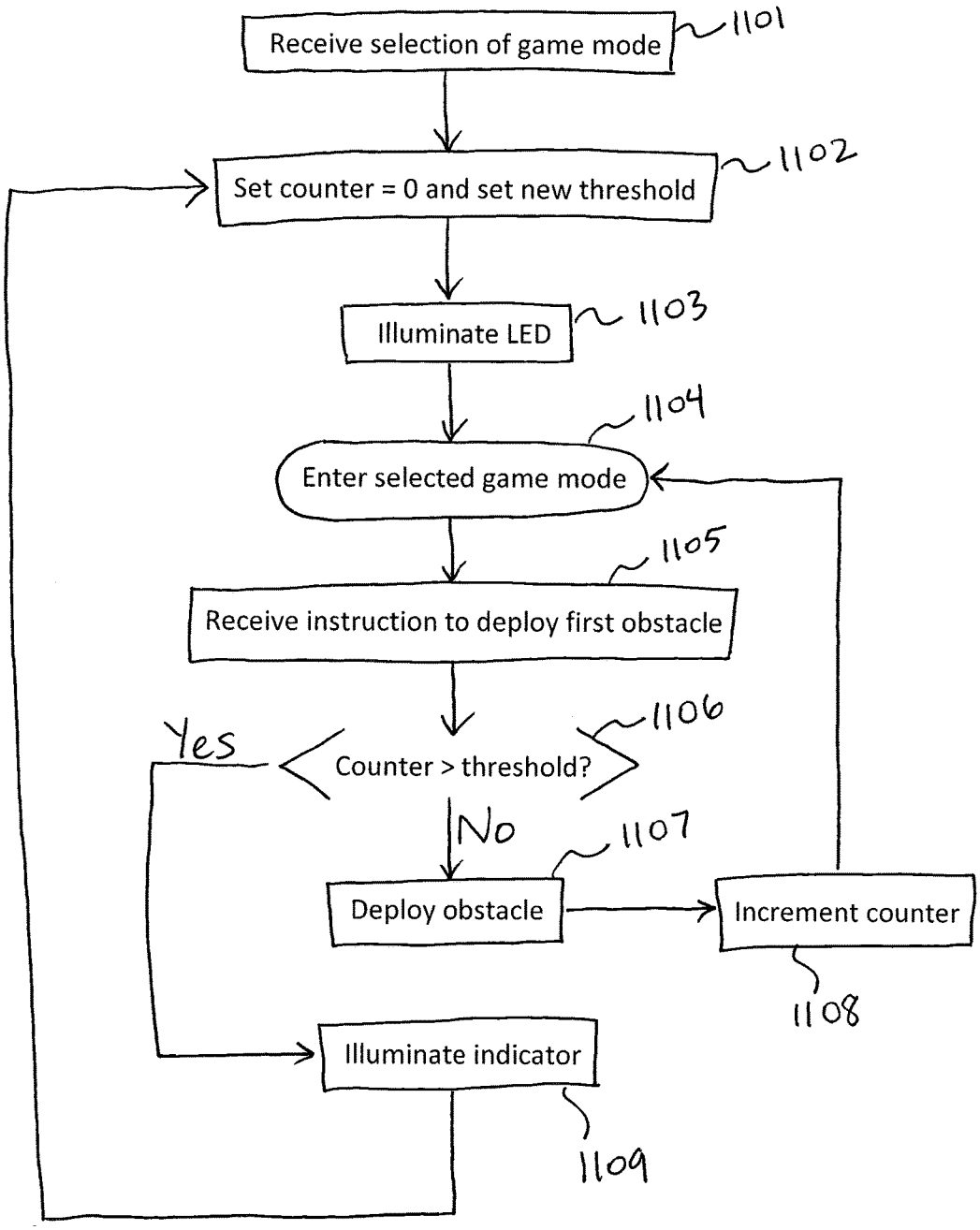
FIG. 11 is a flowchart of a method for multi-player game play, according to an embodiment.

FIG. 11 shows a method for operating a multi-player game mode such as battle mode, according to an embodiment. In battle mode, two or more players play against each other, such as by a first player hitting the ball and a second player controlling the obstacles. The second player chooses when to issue a command to deploy an obstacle in order to attempt to block the ball. In FIG. 11, the battle mode game play includes an element of unpredictability, such that when a counter threshold is reached, the second player's command is ignored. The method includes receiving a selection of a game mode at 1101, such as two-player battle mode. The method includes setting a counter=0 and setting a new threshold for the counter at 1102. The threshold is set arbitrarily, randomly, or pseudo-randomly, within a set range (such as between 1 and 5). The method includes illuminating an LED (or another indicator) at 1103 to indicate that game play has begun, and entering the selected game play at 1104. The method includes receiving instruction to deploy a first obstacle at 1105. For example, the second player may press a button to release a pendulum. The method includes checking the status of the counter at 1106. If the counter is below the threshold, the method includes deploying the obstacle at 1107, incrementing the counter at 1108, and returning to 1104. If the counter has exceeded the threshold, the method does not deploy the obstacle, but instead illuminates an indicator (or makes a noise or some other action) at 1109, to indicate to the player that the command has been ignored and the obstacle not deployed. Then the method returns to 1102 to re-set the counter and threshold. Neither player knows what the threshold is, so the game continues with the players knowing that at any time, a player's instruction to deploy an obstacle may be executed or ignored (or the instruction may be delayed by a set time, such as 3 seconds).

Figure 12:
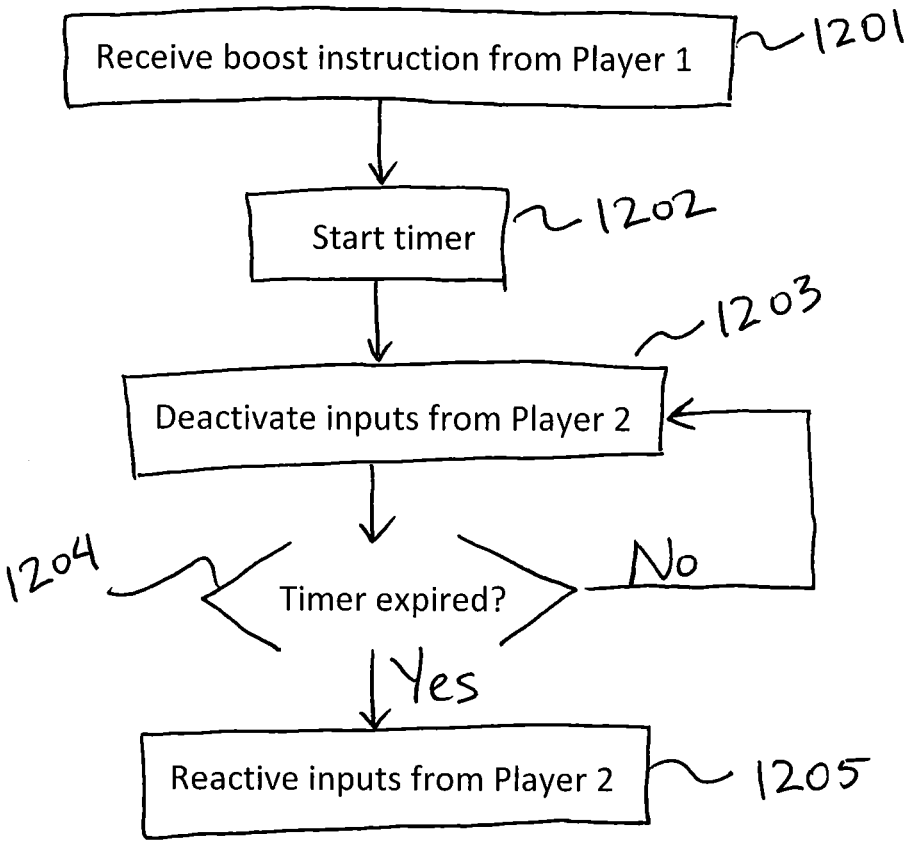
FIG. 12 is a flowchart of a method for multi-player game play, according to an embodiment.

FIG. 12 shows a method for operating a multi-player game mode such as battle mode, according to an embodiment. This figure demonstrates an implementation of a "boost" input, which allows one player to de-activate the inputs from an opposing player. In FIG. 12, the method includes receiving a boost instruction from Player 1, at 1201. The method starts a timer at 1202, and de-activates inputs from Player 2, at 1203. The method checks the timer at 1204, and re-activates inputs from Player 2 when the timer has expired, at 1205. The timer can be set for a desired time interval to give Player 1 a short advantage during game play, such as 5, 10, or 15 seconds, or other durations. This boost input can be combined with other play modes, such as the counter depicted in the method of FIG. 11, to enable players to battle each other within an unpredictable game mode, so that the play of the game is different each time the players play.

Referring again to FIG. 8, the PC 884, smart phone 886, and remote control or clicker 888 can be used to interact with the game unit before, after, or during play. These devices can communicate with the microcontroller 870 by wired or wireless communication. For example, the remote control 888 can be a simple on/off click button (to turn the main unit on or off). In other examples it can include many buttons that, when pressed, activate different obstacles on the main unit, or change obstacle speed, range, or motion. In other examples it can be used to change the mode of game play, such as changing the difficulty level, the number of players, or the mode of play, or to reset the game. The remote control can have an LED that lights up to indicate a game status, such as an obstacle being deployed, or a command being disregarded.

The smart phone 886 can be utilized in the same ways as the remote control, and/or can be utilized along with a downloaded app that provides a graphical user interface for live game play. The app can show the user which obstacles are currently connected to the main unit, which ones are currently deployed, at what speed or level, and other similar information. It can provide feedback when an obstacle is deployed, such as by graphically animating the movement of the obstacle on the display screen, or by other types of graphics, text, or audio. The app can keep track of scoring, by prompting the user to indicate whether each player successfully hit the ball through the obstacle course, or automatically receiving that information from a sensor on the console. During battle mode, a player can tap on an obstacle on the screen to deploy it. New or updated apps can be downloaded to the phone to support new obstacles, new difficulty levels, or other variations in game play. The app can display an interactive two- or three-dimensional representation of the console that receives inputs and displays actions (obstacles deploying or sensors triggering).

Figure 13:
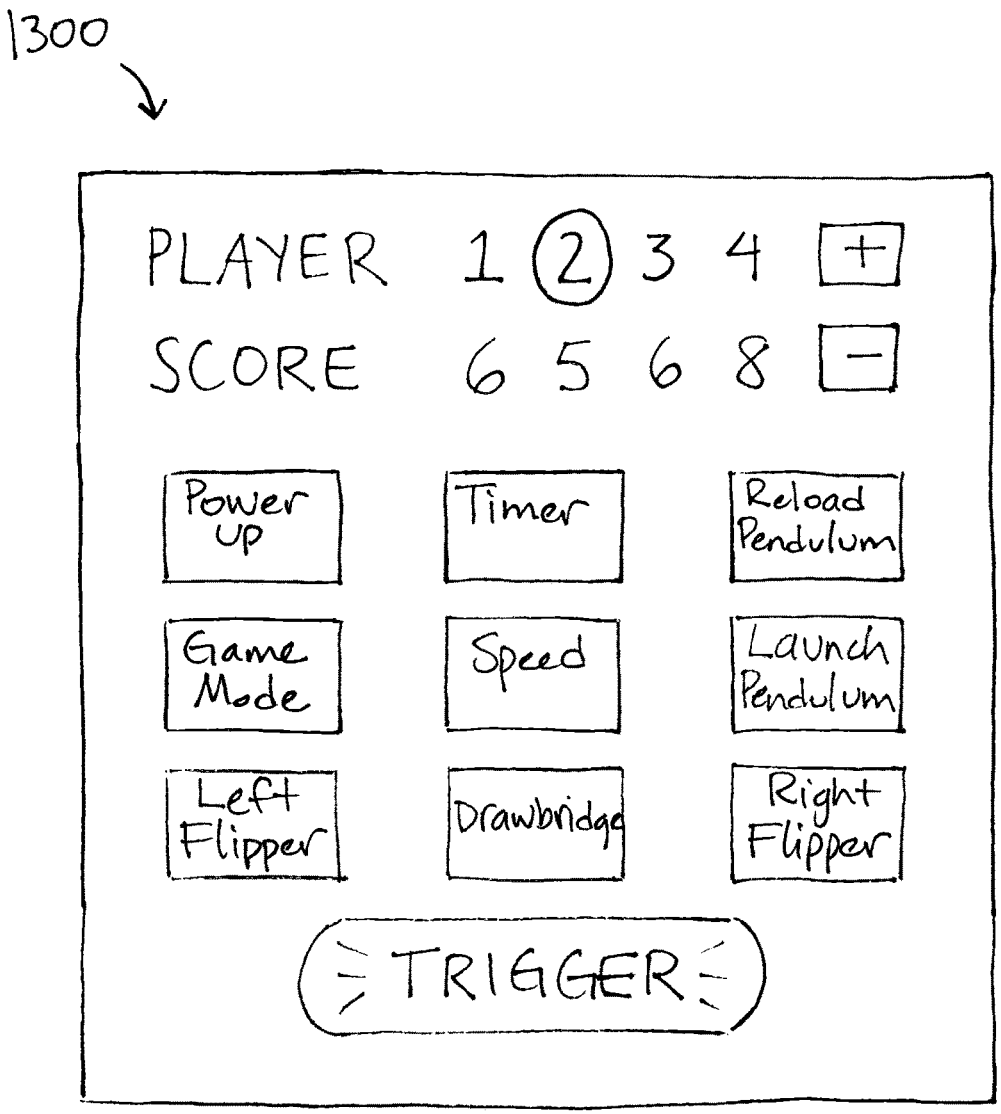
FIG. 13 is a graphical user interface for use during game play, according to an embodiment.

An example graphical user interface (GUI) 1300 is shown in FIG. 13. This GUI can be displayed, for example, on a player's smartphone during game play. The GUI 1300 includes a row at the top listing the number of players, and highlighting the player whose turn it is (in the figure, Player 2 is the selected player, indicated by the circle). Beneath each player number is the player's score (6, 5, 6, and 8 are given as examples). To the right of these rows, "+" (plus) and "–" (minus) buttons are provided to add or remove a point from a player.

Below the player and score rows are several buttons to enable interactions with the game console. The "Power Up" button enables a player to use a power up (described above). The "Timer" button can be used to assign a timer to an obstacle. The "Reload Pendulum" button resets the trigger that holds the pendulum in its raised position (described above). The "Game Mode" button enables the user to switch game modes, for example single player, multi-player, or battle modes, and the difficulty level. The "Speed" button enables a user to adjust the speed of an obstacle, such as a rotating windmill. The "Launch Pendulum" button releases the catch for the pendulum to allow it to swing (described above). The bottom row of buttons enables a user to select one of the obstacles listed—the left flipper, drawbridge, or right flipper, for example—and then the wider "Trigger" button at the bottom is what the user touches to activate the selected obstacle (with the selected speed and timer). These buttons can be animated, such as displaying a small graphic showing a flipper moving back and forth or a drawbridge moving up and down, or flashing. This GUI is simply an example and the buttons and inputs may be rearranged in other screens and formats.

The PC 884 can upload and download information to the microcontroller 870, such as installing new versions of software, or downloading trend statistics or user scores. The PC can be connected by a cable (such as to a USB port) or can communicate wirelessly. For any of these devices, wireless communication can be accomplished by a short-range wireless protocol, such as WiFi, Bluetooth, infrared, or others. In other embodiments, an external memory such as an SD card or thumb drive can be connected to the microcontroller to download new programs, software, or other updates.

In single player or multi-player game mode, a feature called "style points" can be activated to reward the player with the ball for physical activity. For example, the player with the ball holds a clicker (such as clicker 888) or a mobile phone (such as phone 886) that includes an accelerometer that can detect a level of movement. If that level of movement exceeds a threshold—due to the player dancing, jumping, or otherwise moving around with sufficient activity—then the obstacles deployed by the game unit get easier (such as deployed less frequently) or are turned off. Thus, in an example, while the player is dancing or jumping, the obstacles do not deploy, but the obstacles will deploy if the player stops that physical activity. The player can decide whether it is easier to send the ball through the obstacle course by standing still but encountering obstacles, or by moving actively but having the obstacles slowed or deactivated. The speed of the obstacles can even be controlled in proportion or response to the level of movement detected by the accelerometer.

The various game play modes can be chosen by the user via a wireless controller (such as a smart phone), a wireless remote control, or buttons on the console itself. Pressing and holding a button for two seconds can indicate one player (solo play), while pressing and holding for three seconds can indicate two-players (battle mode play). Pressing a second button one time can activate a first obstacle (ex: drawbridge), pressing that button twice can activate a different obstacle (ex: flippers), and pressing it three times can initiate randomization (of all obstacles). Various combinations of user inputs can be used to adjust game settings, difficulty, modes, sensors, and obstacles.

The systems and methods described here may be provided in the form of tangible and non-transitory machine-readable medium or media (such as a hard disk drive, hardware memory, etc.) having instructions recorded thereon for execution by a processor or computer. The set of instructions may include various commands that instruct the computer or processor to perform specific operations such as the methods and processes of the various embodiments described here. The set of instructions may be in the form of a software program or application. The computer storage media may include volatile and non-volatile media, and removable and non-removable media, for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic disk storage, or any other hardware medium which may be used to store desired information and that may be accessed by components of the system. Components of the system may communicate with each other via wired or wireless communication. The components may be separate from each other, or various combinations of components may be integrated together into a medical monitor or processor, or contained within a workstation with standard computer hardware (for example, processors, circuitry, logic circuits, memory, and the like). The system may include processing devices such as microprocessors, microcontrollers, integrated circuits, control units, storage media, and other hardware.

As the above description illustrates, the game unit can be utilized in many different ways, by varying game play (number of players, level of difficulty), removing and replacing obstacles, changing the style of putting or hitting the ball, using different types of balls (sizes, weights, materials, colors), and interacting with targets in the surrounding environment. The game can be configured multiple different ways to provide a wide variety of obstacle courses and competitions between players and the programmed computer. New obstacles can be added, and new programs downloaded to the system. The game unit can be used by individual players in their own homes, at gaming locations (such as laser tag or mini golf), at event centers (for corporate team building), or as part of a party rental package.

It should be noted that components in the figures are shown to demonstrate how they might interact with each other, and are not necessarily to scale. Although exemplary embodiments have been described and illustrated, it should be understood that changes and modifications to these exemplary embodiments are also within the intended scope of this disclosure.

What is claimed is:

1. An obstacle course game unit for a ball, comprising:

a portable console that is movable to position the console above a playing surface to define a path for a rolling ball underneath the console;

a spacer underneath the console, the spacer sized to lift the console above the playing surface by a distance that allows the ball to roll along the path on the playing surface underneath the console;

first and second physical obstacles supported by the console and movable downwardly out of the console and into the path, and upwardly out of the path and into the console, wherein the first obstacle comprises a barrier or a flipper; and a microcontroller, inside the console, in wired or wireless communication with the first and second obstacles, the microcontroller programmed with instructions for:

operating in a first game mode;

operating in a second game mode different from the first game mode;

receiving, from a user, a selection of the first or second game mode; and deploying the first and second obstacles during game play, in accordance with the selected game mode, wherein the console comprises first, second, and third housings wherein each housing comprises a thickness measured in a first direction parallel to the playing surface, a length measured in a second direction parallel to the playing surface and perpendicular to the thickness, and a height measured perpendicular to the playing surface, the length and height being greater than the thickness, the first housing supporting the first physical obstacle and the third housing supporting the second physical obstacle, the first and second obstacles being in series in the first direction along the path, and wherein the first and second and third housings are stacked against each other in the first direction into a contiguous stack.

2. The game unit of claim 1, wherein the first obstacle comprises the barrier, and wherein the barrier translates in a vertical plane into and out of the console.

3. The game unit of claim 1, further comprising a proximity or motion sensor supported by the console for detecting an approaching ball, the sensor in wired or wireless communication with the microcontroller, and wherein deploying the first obstacle during game play comprises deploying the first obstacle in response to a signal from the proximity or motion sensor detecting the approaching ball.

4. The game unit of claim 3, wherein operating in the first game mode comprises setting an arbitrary or random threshold, incrementing a counter when the sensor is triggered, and deploying the first obstacle when the counter passes the threshold.

5. The game unit of claim 1, wherein the first game mode comprises a single player game mode and the second game mode comprises a battle mode.

6. The game unit of claim 5, wherein operating in the first game mode comprises deploying the first obstacle according to a user-selectable difficulty level, and wherein operating in the second game mode comprises receiving, from a user, instructions to deploy the first obstacle, and in response, either deploying the first obstacle or illuminating an indicator.

7. The game unit of claim 5, wherein operating in the second game mode comprises deploying the first obstacle in response to a command from a user, setting an arbitrary or random threshold, incrementing a counter when the first obstacle is deployed, and ignoring the command to deploy the first obstacle when the counter crosses the threshold.

8. The game unit of claim 1, wherein the second obstacle comprises a first rotor rotatable downwardly into and upwardly out of the path, and wherein the first rotor is removably mounted to the third housing, and further comprising a replacement rotor having a shape, style, or dimension that differs from the first removable rotor.

9. The game unit of claim 1, wherein the microcontroller is inside the second housing.

10. The game unit of claim 1, wherein deploying the first obstacle during game play comprises deploying the first obstacle intermittently.

11. The game unit of claim 1, wherein at least one of the housings is configured with a themed component or shape.

12. A game unit for a ball rolling along a path in contact with a playing surface, comprising:

a console movable to position the console above the playing surface to define a path for a rolling ball underneath the console, the console comprising first and second and third separable housings, wherein each housing comprises a thickness measured in a first direction parallel to the playing surface, a length measured in a second direction parallel to the playing surface and perpendicular to the thickness, and a height measured perpendicular to the playing surface, the length and height being greater than the thickness;

a spacer underneath the console, the spacer sized to lift the console above the playing surface by a distance that allows the ball to roll along the path on the playing surface underneath the console;

a barrier movable down into the path and up through an opening into a recess in the first housing;

a first actuator coupled to the barrier to translate the barrier up and down;

a rotor obstacle rotatable, by a second actuator, downwardly into and upwardly out of the path, the rotor obstacle removably mounted on the third housing; and a microcontroller, located inside the console, in wired or wireless communication with the first and second actuators, wherein the barrier and the rotor obstacle are positioned in series in the first direction along the path, and wherein the first and second and third housings are stacked against each other in the first direction into a contiguous stack.

13. The game unit of claim 12, wherein the second actuator rotates the rotor obstacle back and forth in opposite directions within an arc that is less than 360 degrees.

14. The game unit of claim 12, wherein the second actuator rotates the rotor obstacle continuously in the same direction through 360 degrees.

15. The game unit of claim 12, wherein the microcontroller is programmed to receive instructions wirelessly from a tablet or smartphone, the instructions comprising directions for deploying the barrier by the first actuator or the rotor obstacle by the second actuator.

16. An obstacle game system for a ball to move through a path, comprising:

first, second, third, and fourth housings stacked against each other into a contiguous stack and movable with respect to a separate playing surface in contact with the ball to define a path for the ball underneath the housings, wherein each housing comprises a thickness measured in a first direction parallel to the playing surface, a length measured in a second direction parallel to the playing surface and perpendicular to the thickness, and a height measured perpendicular to the playing surface, the length and height of each housing being greater than the thickness of that housing, each housing comprising a front face and an opposite rear face, the housings stacked against each other in series in the first direction along the path, the rear face of the first housing contacting the front face of the second housing, the rear face of the second housing contacting the front face of the third housing, and the rear face of the third housing contacting the front face of the fourth housing;

a spacer sized to lift the housings above the playing surface by a distance that allows the ball to roll along the path on the playing surface underneath the housings;

a proximity sensor supported by the first housing;

a barrier translatable upwardly into a pocket formed by the second housing, between the first and third housings;

a motor, coupled to the barrier, and supported by the third housing;

a rotor obstacle movable downwardly into and upwardly out of the path, the rotor obstacle supported by the fourth housing; and a microcontroller in wired or wireless communication with the proximity sensor, the rotor obstacle, and the motor, the microcontroller located inside one of the housings.

* * * * *